US012173453B2

(12) United States Patent
Goulet et al.

(10) Patent No.: US 12,173,453 B2
(45) Date of Patent: Dec. 24, 2024

(54) EMBOSSED MULTI-PLY TISSUE PRODUCTS

(71) Applicant: Kimberly-Clark Worldwide, Inc., Neenah, WI (US)

(72) Inventors: Mike Thomas Goulet, Neenah, WI (US); Sarah Ann Funk, Omro, WI (US); Michaela Ann Busch, Neenah, WI (US); Kelly Anne Balzereit, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 434 days.

(21) Appl. No.: 17/290,427

(22) PCT Filed: Oct. 31, 2018

(86) PCT No.: PCT/US2018/058317

§ 371 (c)(1),
(2) Date: Apr. 30, 2021

(87) PCT Pub. No.: WO2020/091748

PCT Pub. Date: May 7, 2020

(65) Prior Publication Data

US 2021/0381172 A1 Dec. 9, 2021

(51) Int. Cl.

| | |
|---|---|
| ***D21H 27/02*** | (2006.01) |
| ***D21H 27/00*** | (2006.01) |
| ***D21H 27/40*** | (2006.01) |

(52) U.S. Cl.

CPC ..... *D21H 27/02* (2013.01); *D21H 27/007* (2013.01); *D21H 27/40* (2013.01)

(58) Field of Classification Search

CPC .... D21H 27/002; D21H 27/02; D21H 27/005; D21H 27/007; D21H 23/02

See application file for complete search history.

(56) References Cited

U.S. PATENT DOCUMENTS 5,399,412 A 3/1995 Sudall et al.
5,672,248 A 9/1997 Wendt et al.
(Continued)

FOREIGN PATENT DOCUMENTS

CN 1244228 A 2/2000
CN 1326523 A 12/2001
(Continued)

OTHER PUBLICATIONS

Co-pending U.S. Appl. No. 17/266,452, filed Feb. 5, 2021, by LeCount et al. for "Embossed Multi-Ply Tissue Products".
(Continued)

*Primary Examiner* — Jacob T Minskey
*Assistant Examiner* — Stephen M Russell
(74) *Attorney, Agent, or Firm* — KIMBERLY-CLARK WORLDWIDE, INC.

(57) ABSTRACT

The present invention provides an embossed multi-ply tissue product that is visually pleasing and has improved physical attributes. For example, the inventive multi-ply tissue products have reduced stiffness, such as a GM Flexural Rigidity less than about 600 mg*cm, improved absorbency, such as a Residual Water (WResidual) value less than about 0.15 g, and improved wet resiliency, such as a wet elastic strain ratio greater than about 32 percent.

21 Claims, 9 Drawing Sheets

(56) References Cited

U.S. PATENT DOCUMENTS

| | | | | |
|---|---|---|---|---|
| 6,602,577 | B1 | 8/2003 | Ostendorf et al. | |
| 6,808,709 | B1 | 10/2004 | Hiatt et al. | |
| 7,311,800 | B2 | 12/2007 | Russell et al. | |
| 7,687,140 | B2 | 3/2010 | Manifold et al. | |
| 7,704,601 | B2 | 4/2010 | Manifold et al. | |
| 7,744,723 | B2 | 6/2010 | Sheehan et al. | |
| 7,744,981 | B2 | 6/2010 | Vazquez Santiago | |
| 7,811,665 | B2 | 10/2010 | Manifold et al. | |
| 7,935,409 | B2 | 5/2011 | Burazin et al. | |
| 7,939,168 | B2 | 5/2011 | Manifold et al. | |
| 7,960,020 | B2 | 6/2011 | Manifold et al. | |
| 8,025,966 | B2 | 9/2011 | Manifold et al. | |
| 8,192,836 | B2 | 6/2012 | Manifold et al. | |
| 8,334,049 | B2 | 12/2012 | Manifold et al. | |
| 8,377,258 | B2 | 2/2013 | Mellin et al. | |
| 8,460,786 | B2 | 6/2013 | Manifold et al. | |
| 8,597,781 | B2 | 12/2013 | Manifold et al. | |
| 8,657,997 | B2 | 2/2014 | Polat et al. | |
| 8,753,737 | B2 | 6/2014 | McNeil et al. | |
| 9,051,690 | B2 | 6/2015 | Hermans et al. | |
| 9,085,855 | B2 | 7/2015 | Manifold et al. | |
| 9,326,646 | B2 | 5/2016 | Mellin et al. | |
| 9,408,503 | B2 | 8/2016 | Manifold et al. | |
| 9,506,203 | B2 | 11/2016 | Ramaratnam et al. | |
| 9,593,452 | B2 | 3/2017 | Manifold et al. | |
| 9,719,213 | B2 | 8/2017 | Miller, IV et al. | |
| 9,725,853 | B2 | 8/2017 | Ramaratnam et al. | |
| 2004/0018369 | A1 | 1/2004 | Goulet et al. | |
| 2005/0045293 | A1* | 3/2005 | Hermans | D21H 21/22 162/111 |
| 2006/0130988 | A1 | 6/2006 | Hermans et al. | |
| 2006/0237154 | A1 | 10/2006 | Edwards et al. | |
| 2008/0102250 | A1* | 5/2008 | Ostendorf | D21H 27/02 428/153 |
| 2010/0294444 | A1 | 11/2010 | Mellin et al. | |
| 2010/0297400 | A1 | 11/2010 | Mellin et al. | |
| 2011/0189451 | A1* | 8/2011 | Manifold | D21H 27/002 428/219 |
| 2011/0212299 | A1 | 9/2011 | Nyangiro et al. | |
| 2012/0043037 | A1 | 2/2012 | Polat et al. | |
| 2012/0244320 | A1* | 9/2012 | Sauter | D21H 27/002 264/293 |
| 2013/0143001 | A1* | 6/2013 | Manifold | D06C 23/04 428/167 |
| 2014/0141203 | A1* | 5/2014 | Sartini | D21H 27/02 264/293 |
| 2016/0265166 | A1 | 9/2016 | Maladen et al. | |
| 2017/0306566 | A1* | 10/2017 | Bailey | D21H 27/40 |
| 2018/0142422 | A1 | 5/2018 | Baum et al. | |
| 2018/0298560 | A1* | 10/2018 | Burazin | D21H 27/02 |
| 2019/0119853 | A1* | 4/2019 | Sierra | D21F 11/006 |

FOREIGN PATENT DOCUMENTS

| | | | |
|---|---|---|---|
| CN | 1508006 | A | 6/2004 |
| CN | 1612963 | A | 5/2005 |
| CN | 101563445 | A | 10/2009 |
| CN | 202235094 | U | 5/2012 |
| CN | 103069076 | A | 4/2013 |
| CN | 104822520 | A | 8/2015 |
| CN | 104999708 | A | 10/2015 |
| CN | 106264275 | A | 1/2017 |
| JP | 2007061637 | A | 3/2007 |
| WO | 2018159824 | A1 | 9/2018 |
| WO | 2018166572 | A1 | 9/2018 |

OTHER PUBLICATIONS

Co-pending U.S. Appl. No. 17/269,699, filed Feb. 19, 2021, by LeCount al. for “Embossed Multi-Ply Tissue Products”.

* cited by examiner

EMBOSSED MULTI-PLY TISSUE PRODUCTS

BACKGROUND

In the manufacture of paper products, particularly tissue products, such as facial tissue, bath tissue, paper towels, napkins, and the like, a wide variety of product characteristics must be given attention in order to provide a final product with the appropriate blend of attributes suitable for the product's intended purposes. Among these various attributes, improving strength, absorbency, caliper and wet resiliency have always been major objectives.

Traditionally, many of these paper products have been made using a wet-pressing process in which a significant amount of water is removed from a wet laid web by pressing or squeezing water from the web prior to final drying. In particular, while supported by an absorbent papermaking felt, the web is squeezed between the felt and the surface of a rotating heated cylinder (Yankee dryer) using a pressure roll as the web is transferred to the surface of the Yankee dryer. The web is thereafter dislodged from the Yankee dryer with a doctor blade (creping), which serves to partially debond the web by breaking many of the bonds previously formed during the wet-pressing stages of the process. The web can be creped dry or wet. Creping generally improves the softness of the web, but at the expense of a significant loss in strength.

More recently, through-air drying has become a more common means of drying paper webs. Through-air drying provides a relatively noncompressive method of removing water from the web by passing hot air through the web until it is dry. More specifically, a wet-laid web is transferred from the forming fabric to a coarse, highly permeable through-air drying fabric and retained on the through-air drying fabric until it is dry. The resulting dried web is softer and bulkier than a conventionally-dried uncreped sheet because fewer bonds are formed and because the web is less compressed. Squeezing water from the wet web is eliminated, although the use of a pressure roll to subsequently transfer the web to a Yankee dryer for creping may still be used.

While through-air drying may improve the softness and bulk of the web, subsequent converting of the web is often required to further increase bulk and to impart the web with an aesthetic quality. To that end single- and multi-ply webs are subjected to embossing. During a typical embossing process, a web substrate is fed through a nip formed between juxtaposed generally axially parallel rolls. Embossing elements on the rolls compress and/or deform the web. If a multi-ply product is being formed, two or more plies are fed through the nip and regions of each ply are brought into a contacting relationship with the opposing ply. The embossed regions of the plies may produce an aesthetic pattern and provide a means for joining and maintaining the plies in face-to-face contacting relationship and may increase the bulk of the product.

Typically embossed products having a relatively high degree of bulk and an aesthetically pleasing decorative pattern having a cloth-like appearance are desired by consumers. These attributes must be balanced against other product properties such as softness, which may be measured as stiffness, wet resiliency and absorbency.

Thus, there remains a need in the art for an embossed tissue product that is more aesthetically pleasing while providing important product properties such as reduced stiffness, improved wet resiliency and increased absorbency.

SUMMARY

The present inventors have now discovered that various tissue manufacturing techniques, such as embossing and wet molding, may be used to create a multi-ply tissue product that is both aesthetically pleasing and has improved physical attributes. For example, the present invention provides a tissue product that has been manufactured by a process, such as through-air drying, which provides the web with a first pattern and is combined with another web and embossed to provide a second pattern. The inventive tissue products have reduced stiffness, such as a GM Flexural Rigidity less than about 600 mg*cm, improved absorbency, such as a Residual Water ($W_{Residual}$) value less than about 0.15 g, and improved wet resiliency, such as a wet elastic strain ratio greater than about 32 percent.

Accordingly, in one embodiment, the present invention provides an embossed multi-ply tissue product comprising a first outer surface, an opposed second outer surface and a plurality of embossments disposed on at least the first outer surface, the product having a Drip Time (DT) greater than about 30 seconds, more preferably greater than about 40 seconds and still more preferably greater than about 45 seconds and even more preferably greater than 60 seconds.

In another embodiment the present invention provides a dripless tissue product comprising a first tissue ply and a second tissue ply, the first tissue ply having a first upper surface and a plurality of embossments disposed thereon, the tissue product having a Fluid Discharge Weight (WD) of less than 0.15 g.

In yet another embodiment the present invention provides an embossed multi-ply tissue product having a first outer surface and an opposed second outer surface, the product comprising first and second through-air dried tissue plies, the first through-air dried tissue ply having a first surface which forms the first outer surface of the product and comprises a background pattern and a first embossing pattern comprising discrete, non-linear line elements, wherein the embossing pattern covers from about 5.0 to about 10.0 percent of the first outer surface of the tissue product, the product having a basis weight from about 50 to about 60 gsm, a GMT from about 3,000 to about 4,000 g/3" and a Drip Time (DT) greater than about 30 seconds.

In still another embodiment the present invention provides an embossed multi-ply tissue product comprising two or more plies adhesively bonded together in a face-to-face relationship, wherein at least one of the plies comprises a plurality of line embossments disposed in an embossing pattern, wherein the embossing pattern covers less than about 10 percent of the surface area of the ply. In certain preferred embodiments the embossing pattern comprises discrete, non-linear line elements. In other embodiments at least about 90 percent, and more preferably at least about 95 percent, of the embossed area consists of line elements having a length greater than about 20.0 mm, such as from about 20.0 to about 60.0 mm. In other embodiments only one of the tissue plies comprises embossments and in still other embodiments the embossed tissue ply is substantially free from dot embossments.

In another embodiment the present invention provides a method for making an embossed multi-ply fibrous structure, the method comprises the steps of (a) providing a first tissue ply; (b) embossing a first embossing pattern on the first ply by conveying the ply through an embossing nip, wherein the embossed area is less than about 10 percent; (c) providing a second tissue ply; (d) applying an adhesive to at least one of the tissue plies; and (e) adhesively bonding the first and the second tissue plies together in a face-to-face relationship. In certain embodiments the embossing pattern comprises discrete, non-linear line elements having a length greater than about 20.0 mm, such as from about 20.0 to about 50.0 mm, such as from about 25.0 to about 40.0 mm. In other embodiments the second ply is unembossed. In still other embodiments the first and second tissue plies are through-air dried and may be either creped or uncreped and may have a background pattern consisting essentially of line elements that are the result of wet molding of the tissue ply.

DEFINITIONS

Figure 1A:
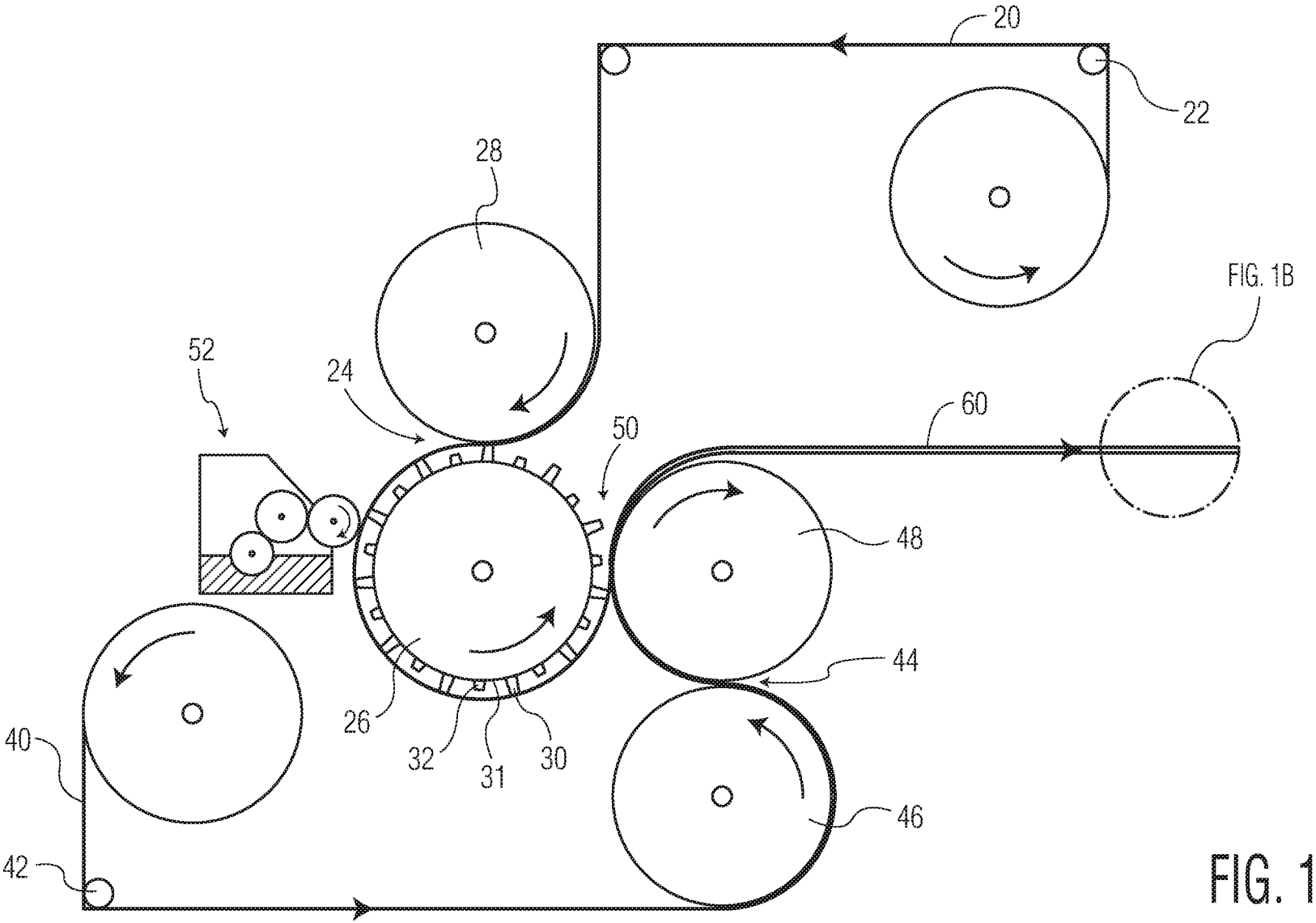
FIG. 1A is a schematic view of an embossing process useful in preparing products according to the present invention and FIG. 1B illustrates an embossed tissue product produced by the process.

As used herein, a "tissue product" generally refers to various paper products, such as facial tissue, bath tissue, paper towels, napkins, and the like. Normally, the basis weight of a tissue product of the present invention is greater than about 40 grams per square meter (gsm), more preferably greater than about 45 gsm and still more preferably greater than about 50 gsm, such as from about 45 to about 65 gsm and more preferably from about 50 to about 60 gsm.

As used herein, the term "basis weight" generally refers to the bone dry weight per unit area of a tissue and is generally expressed as grams per square meter (gsm). Basis weight is measured using TAPPI test method T-220.

The term "ply" refers to a discrete product element. Individual plies may be arranged in juxtaposition to each other. The term may refer to a plurality of web-like components such as in a multi-ply facial tissue, multi-ply bath tissue, multi-ply paper towel, multi-ply wipe, or multi-ply napkin, which may comprise two, three, four or more individual plies arranged in juxtaposition to each other where one or more plies may be attached to one another such as by mechanical or chemical means.

As used herein, the term "layer" refers to a plurality of strata of fibers, chemical treatments, or the like, within a ply.

As used herein, the terms "layered tissue web" "multi-layered tissue web," "multi-layered web," and "multi-layered paper sheet," generally refer to sheets of paper prepared from two or more layers of aqueous papermaking furnish which are preferably comprised of different fiber types. The layers are preferably formed from the deposition of separate streams of dilute fiber slurries upon one or more endless foraminous screens. If the individual layers are initially formed on separate foraminous screens, the layers are subsequently combined (while wet) to form a layered composite web.

As used herein the term "machine direction" (MD) generally refers to the direction in which a tissue web or product is produced. The term "cross-machine direction" (CD) refers to the direction perpendicular to the machine direction.

As used herein, the term "caliper" is the representative thickness of a single sheet (caliper of tissue products comprising one or more plies is the thickness of a single sheet of tissue product comprising all plies) measured in accordance with TAPPI test method T402 using a ProGage 500 Thickness Tester (Thwing-Albert Instrument Company, West Berlin, N.J.). The micrometer has an anvil diameter of 2.22 inches (56.4 mm) and an anvil pressure of 132 grams per square inch (per 6.45 square centimeters) (2.0 kPa).

As used herein, the term "sheet bulk" refers to the quotient of the caliper (μm) divided by the bone dry basis weight generally expressed as grams per square meter (gsm). The resulting sheet bulk is expressed in cubic centimeters per gram (cc/g). Tissue products prepared according to the present invention may, in certain embodiments, have a sheet bulk greater than about 12 cc/g, more preferably greater than about 15 cc/g and still more preferably greater than about 17 cc/g, such as from about 12 to about 20 cc/g.

As used herein, the term "slope" refers to slope of the line resulting from plotting tensile versus stretch and is an output of the MTS TestWorks™ in the course of determining the tensile strength as described in the Test Methods section herein. Slope is reported in the units of grams (g) per unit of sample width (inches) and is measured as the gradient of the least-squares line fitted to the load-corrected strain points falling between a specimen-generated force of 70 to 157 grams (0.687 to 1.540 N) divided by the specimen width.

As used herein, the term "geometric mean slope" (GM Slope) generally refers to the square root of the product of machine direction slope and cross-machine direction slope. While the GM Slope may vary amongst tissue products prepared according to the present disclosure, in certain embodiments, tissue products have a GM Slope less than about 14,000 g, more preferably less than about 13,500 g and still more preferably less than about 13,000 g, such as from about 9,000 to about 14,000 g.

As used herein, the term "geometric mean tensile" (GMT) refers to the square root of the product of the machine direction tensile strength and the cross-machine direction tensile strength of the web. While the GMT may vary, tissue products prepared according to the present disclosure may, in certain embodiments, have a GMT greater than about 1,500 g/3", and more preferably greater than about 1,750 g/3" and still more preferably greater than about 2,000 g/3", such as from about 1,500 to about 4,000 g/3", such as from about 2,000 to about 3,500 g/3".

As used herein, the term "stiffness index" refers to the quotient of the geometric mean tensile slope, defined as the square root of the product of the MD and CD slopes (typically having units of kg), divided by the geometric mean tensile strength (typically having units of grams per three inches).

$$\text{Stiffness Index} = \frac{\sqrt{MD\ \text{Tensile Slope (kg)} \times CD\ \text{Tensile Slope(kg)}}}{GMT\ (\text{g}/3'')} \times 1{,}000$$

While the Stiffness Index may vary, tissue products prepared according to the present disclosure may, in certain embodiments, have a Stiffness Index less than about 6.00, more preferably less than about 5.00 and still more preferably less than about 4.00, such as from about 3.00 to about 6.00, such as from about 3.50 to about 4.50.

As used herein the term "tensile ratio" generally refers to the ratio of machine direction (MD) tensile (having units of g/3") and the cross-machine direction (CD) tensile (having units of g/3"). While the Tensile Ratio may vary, tissue products prepared according to the present disclosure may, in certain embodiments, have a Tensile Ratio less than about 2.0, such as from about 1.0 to about 2.0, such as from about 1.2 to about 1.5.

As used herein the term "Wet elastic strain ratio" is the ratio of the elastic strain to the applied strain when a wetted sheet is compressed to 300 g/in$^2$ (4569 Pa) measured according to the Wet Resiliency test method set forth in the Test Methods Section below. The wet elastic strain ratio equals:

$$\text{Wet Elastic Strain Ratio} = \frac{\ln\left(\frac{C2_5}{C1_{300}}\right)}{\ln\left(\frac{C1_5}{C1_{300}}\right)}$$

Where $C1_5$ is the caliper of the sheet under 5 g/in$^2$ prior to the first compression cycle, also referred to herein as the Initial Wet Caliper, $C1_{300}$ is the caliper of the sample under a load of 300 g/in$^2$ (4569 Pa) on the first compression cycle and $C2_5$ is the caliper of the sheet under 5 g/in$^2$ on the second compression cycle (immediately after loading to 300 g/in$^2$ on the first cycle). Caliper generally has units of millimeters (mm) when measuring elastic strain ratio. The wet elastic strain ratio will range between one for a completely elastic solid with no plastic deformation, to zero for a perfectly plastic solid with no elastic recovery.

As used herein the term "geometric mean flexural rigidity" (GM Flexural Rigidity) generally refers to the relative stiffness of a tissue product or web and is measured according to ASTM D1388, as described in the Test Methods section below. GM Flexural Rigidity typically has units of mg*cm$^2$/cm.

As used herein, the term "residual water" ($W_{Residual}$) refers to the mass of water not initially absorbed by a tissue sample, as measured according to the Drip Test described in the Test Methods section below. Residual water typically has units of grams (g).

As used herein, the term "drip time" (DT) refers the time required for a wetted tissue sample to drip and is measured according to the Drip Test described in the Test Methods section below. Drip time typically has units of seconds (s).

As used herein, the term "water retained" ($W_{Retained}$) refers to the mass of water retained by a sample at the conclusion of the Drip Test described in the Test Methods section below. Water Retained typically has units of grams (g).

As used herein the term "line element" refers to an element, such as an embossing element, in the shape of a line, which may be continuous, discrete, interrupted, and/or a partial line with respect to a tissue product on which it is present. The line element may be of any suitable shape such as straight, bent, kinked, curled, curvilinear, serpentine, sinusoidal, and mixtures thereof that may form a regular or irregular, periodic or non-periodic lattice work of structures wherein the line element exhibits a length along its path of at least 20 mm. In one example, the line element may comprise a plurality of discrete elements, such as dots and/or dashes for example, that are oriented together to form a line element.

As used herein the term "non-linear element" means a multi-directional, uninterrupted portion of an element having a length (L). In certain instances the length may be about 20.0 mm or greater. The length (L) of the element is generally measured along the uninterrupted portion of the element, such as from point A to point B of FIG. 2. In one example, such as that illustrated in FIG. 2, a non-linear element 80 may comprise first and second unidirectional, uninterrupted, linear element segments 84, 86. Generally non-linear elements are disposed on the surface of the tissue product and may result from embossing the product. In certain preferred embodiments, such as that illustrated in FIG. 3, the tissue product 60 may comprise substantially identical, discrete, non-linear embossed elements 80, which form a motif 94 that is repeated to form a pattern 90 having a pattern principle axis of orientation 92.

As used herein the term "multi-directional" when referring to an element, such as a non-linear embossed element, means that the element has at least a first and a second directional vector. For example, with reference to FIG. 2, the non-linear element 80 has a first segment 84 that has a first directional vector 85 extending in a first direction and the second segment 86 has a second directional vector 87 extending in a second direction that is different than the direction of the first vector 85.

As used herein the term "discrete" when referring to an element, such as a non-linear embossed element, means that the non-linear element has at least one immediate adjacent region of the tissue product that is different from the non-linear element. For example, with reference to FIG. 3, the embossing pattern 90 comprises a plurality of embossed non-linear elements, such as elements 80*a* and 80*b*, which are separated from one another by an unembossed region 89 of the tissue product 60.

As used herein the term "uninterrupted" when referring to an element, such as a non-linear embossed element, means that along the length of a given non-linear element, the non-linear element is not intersected by a region that is different from the non-linear element. Variations of the tissue ply within a given non-linear element such as those resulting from the manufacturing process such as forming, molding or creping are not considered to result in regions that are different from the non-linear element and thus do not interrupt the non-linear element along its length.

As used herein the term "substantially machine direction oriented" when referring to an element disposed on the surface of a tissue ply or product, such as a non-linear element, embossing pattern, or a background pattern, generally means that the element's principle axis of orientation is positioned at an angle of greater than about 45 degrees to the cross-machine direction (CD) axis.

As used herein the term "pattern" generally refers to the arrangement of one or more design elements. Within a given pattern the design elements may be the same or may be different, further the design elements may be the same relative size or may be different sizes. For example, in one embodiment, a single design element may be repeated in a pattern, but the size of the design element may be different from one design element to the next within the pattern.

Figure 2:
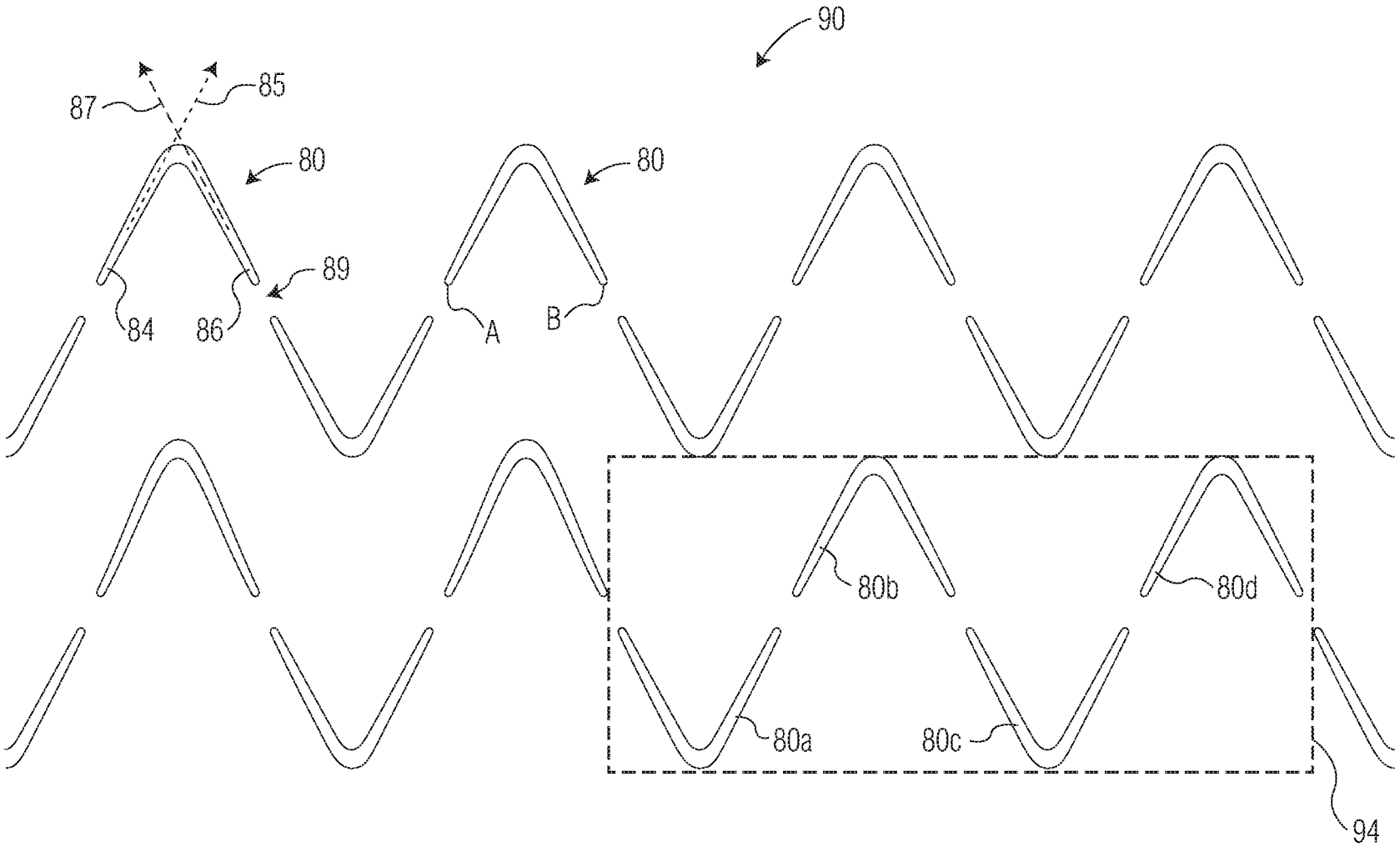
FIG. 2 illustrates an embossing pattern useful in the present invention.

As used herein the term "motif" generally refers to the non-random recurrence of one or more embossed elements within an embossing pattern. The recurrence of the element may not necessarily occur within a given sheet, for example, in certain embodiments the design element may be a continuous element extending across two adjacent sheets separated from one another by a line of perforations. With reference to FIG. 2 the embossing pattern 90 comprises a motif 94 consisting of three discrete non-linear elements 80*a*, 80*b*, 80*c*.

As used herein the term "background pattern" refers to a pattern that substantially covers the surface of a tissue product. One of skill in the art may appreciate that a background pattern may be distinguished from a repeating pattern because a repeating pattern may comprise a plurality of line segment patterns, line segment axes, and cells whereas, in some embodiments, a background pattern may only comprise a single feature which is repeated at any frequency and/or interval. In other embodiments, a background pattern comprises a plurality of features which may form a repeating unit. A repeating unit may be described as a design comprising a plurality of one or more base patterns.

A background pattern may be formed using any means known in the art. For example, in some embodiments, a background pattern may be introduced into the surface of a tissue product using embossing or micro-embossing. Exemplary embodiments of micro embossing are described, for example, in US Publication No. 2005/0230069. In other embodiments, a background pattern may be introduced into the surface of the tissue sheet or product during the papermaking process using a textured or patterned papermaking fabric as described in, for example, U.S. Pat. No. 7,611,607.

As used herein the term "embossed" when referring to a tissue product means that during the manufacturing process one or more of the tissue plies that make up the product have been subjected to a process which converts a smooth surfaced tissue web to a decorative surface by replicating an embossing pattern on one or more embossing rolls, which form a nip through which the tissue web passes. Embossed does not include wet molding, creping, microcreping, printing or other processes that may impart a texture and/or decorative pattern to a tissue web.

As used herein, the term "embossing pattern" generally refers to the arrangement of one or more design elements across at least one dimension of a tissue product surface that are imparted by embossing the tissue product. The pattern may comprise a linear element, a non-linear element, a discrete non-linear element or other shapes. The embossing pattern comprises a portion of the tissue product lying out of plane with the surface plane of the tissue product. In general, the embossing pattern results from embossing the tissue product resulting in a depressed area having a z-directional elevation that is lower than the surface plane of the tissue product. The depressed areas can suitably be one or more linear elements, discrete elements or other shapes.

As used herein, the term "embossment plane" generally refers to the plane formed by the upper surface of the depressed portion of the tissue product forming an embossment. Generally the embossing element plane lies below the tissue product's surface plane. In certain embodiments the tissue product of the present invention may have a single embossing element plane, while in other embodiments the structure may have multiple embossing element planes. The embossing element plane is generally determined by imaging a cross-section of the tissue product and drawing a line tangent to the upper most surface of an embossment where the line is generally parallel to the x-axis of the tissue product.

As used herein the term "embossed area" generally refers to the percentage of a tissue product's surface area that is covered by embossments as measured using a Keyence VHX-5000 Digital Microscope (Keyence Corporation, Osaka, Japan) and described in the Test Methods section below.

DETAILED DESCRIPTION

The present inventors have successfully balanced the manufacture of a molded, three-dimensional tissue sheet with embossing and lamination to create a multi-ply tissue product that is visually pleasing and has improved physical attributes. For example, the inventive multi-ply tissue products have reduced stiffness, such as a GM Flexural Rigidity less than about 600 mg*cm, improved absorbency, such as a Residual Water ($W_{Residual}$) value less than about 0.15 g and improved wet resiliency, such as a wet elastic strain ratio greater than about 32 percent. In certain instances the improvement in physical attributes is accompanied by an improvement in the aesthetic appeal of the product, such as a multi-ply tissue product having first and second patterns, where the first pattern is embossed and the second pattern is unembossed. The first embossed pattern may cover a relatively minor percentage of the total surface area of the tissue product, such as less than about 15 percent and more preferably less than about 10 percent. Additionally, the embossed pattern may comprise discrete, non-linear line elements which consumers find visually appealing, particularly when the line elements are arranged in geometric patterns that give the product a cloth-like appearance.

Accordingly, in certain embodiments, the invention provides an embossed multi-ply tissue product comprising two or more tissue plies having a background pattern imparted from wet molding of the sheet during manufacture and a total embossed area less than about 15 percent or less, such as less than about 12 percent and more preferably less than about 10 percent, such as from about 5 to about 15 percent, and having improved stiffness, wet resiliency and absorbency over the prior art. In certain instances the background pattern may comprise a plurality of parallel, equally spaced apart line elements that are interrupted by the embossing pattern which also comprises non-linear line elements.

In other embodiments the present invention provides an embossed multi-ply tissue product comprising two or more plies adhesively bonded together in a face-to-face relationship, wherein at least one of the plies comprises a background pattern and a plurality of line embossments disposed in an embossing pattern. Preferably the background pattern is not embossed and the embossed area is less than about 15 percent and more preferably less than about 10 percent. The resulting tissue product generally has improved stiffness, wet resiliency and absorbency over the prior art.

The multi-ply embossed tissue products of the present invention generally comprise two, three or four tissue plies made by well-known wet-laid papermaking processes such as, for example, creped wet pressed, modified wet pressed, creped through-air dried (CTAD) or uncreped through-air dried (UCTAD). For example, creped tissue webs may be formed using either a wet pressed or modified wet pressed process such as those disclosed in U.S. Pat. Nos. 3,953,638, 5,324,575 and 6,080,279, the disclosures of which are incorporated herein in a manner consistent with the instant application. In these processes the embryonic tissue web is transferred to a Yankee dryer, which completes the drying process, and then creped from the Yankee surface using a doctor blade or other suitable device.

In a particularly preferred embodiment one or more of the tissue plies may be manufactured by a through-air dried process. In such processes the embryonic web is noncompressively dried. For example, tissue plies useful in the present invention may be formed by either creped or uncreped through-air dried processes. Particularly preferred are uncreped through-air dried webs, such as those described in U.S. Pat. No. 5,779,860, the contents of which are incorporated herein in a manner consistent with the present disclosure.

In other embodiments one or more of the tissue plies may be manufactured by a process including the step of using pressure, vacuum, or air flow through the wet web (or a combination of these) to conform the wet web into a shaped fabric and subsequently drying the shaped sheet using a Yankee dryer, or series of steam heated dryers, or some other means, including but not limited to tissue made using the ATMOS process developed by Voith or the NTT process developed by Metso; or fabric creped tissue, made using a process including the step of transferring the wet web from a carrying surface (belt, fabric, felt, or roll) moving at one speed to a fabric moving at a slower speed (at least 5 percent slower) and subsequently drying the sheet. Those skilled in the art will recognize that these processes are not mutually exclusive, e.g., an uncreped TAD process may include a fabric crepe step in the process.

The instant multi-ply tissue product may be constructed from two or more plies that are manufactured using the same or different tissue making techniques. In a particularly preferred embodiment the multi-ply tissue product comprises two thorough-air dried tissue plies where each ply has a basis weight greater than about 20 gsm, such as from about 20 to about 50 gsm, such as from about 22 to about 30 gsm, where the plies have been attached to one another by a glue laminating embossing process which provides the tissue product with an embossing pattern on at least one of its outer surfaces. Certain aspects of the embossing pattern will be discussed in more detail below.

In certain instances the tissue products are manufactured using papermaking fabrics, such as woven through-air drying fabrics, having surfaces with three-dimensional topography which facilitates the molding and structuring of the nascent tissue web during manufacture. The molding and structuring of the web during manufacture may impart three-dimensionality to the resulting tissue sheet or ply. In certain instances the three-dimensionality imparted to the resulting sheet or ply affects the physical properties of the finished tissue product, such as sheet bulk, stretch, and tensile energy absorption. For example, the finished product may comprise a plurality of substantially machine direction (MD) oriented ridges that may be pulled out when the product is subjected to strain in the cross-machine direction (CD) resulting in increased CD stretch and tensile energy absorption.

Suitable three-dimensional fabrics useful for purposes of this invention are those fabrics having a top surface, also referred to as the web contacting surface, and a bottom surface where the top surface comprises a three-dimensional topography. During wet molding or through-air drying the wet tissue web contacts the top surface and is strained into a three-dimensional topographic form corresponding to the top surface's three-dimensional topography.

In certain instances the three-dimensional fabrics may have textured sheet-contacting surfaces comprising substantially continuous machine direction ridges separated by valleys such as those disclosed in U.S. Pat. No. 6,998,024, the contents of which are incorporated herein in a manner consistent with the present disclosure. In certain preferred instances fabrics useful in the manufacture of tissue products according to the present invention may have a textured sheet contacting surface comprising substantially continuous machine-direction ridges separated by valleys, said ridges being formed of multiple warp strands grouped together, wherein the height of the ridges is from 0.5 to about 3.5 mm, the width of the ridges is about 0.3 centimeter or greater, and the frequency of occurrence of the ridges in the cross-machine direction of the fabric is from about 0.2 to about 3 per centimeter.

In yet other instances the three-dimensional fabrics may have textured sheet-contacting surfaces comprising substantially continuous machine direction ridges separated by valleys such as those disclosed in U.S. Pat. No. 7,611,607, the contents of which are incorporated herein in a manner consistent with the present disclosure. Such fabrics may have web contacting surfaces comprising substantially continuous machine-direction ridges separated by valleys, the ridges being formed of multiple warp strands grouped together and supported by multiple shute strands of two or more diameters; wherein the width of ridges is from about 1 to about 5 mm, more specifically about 1.3 to 3.0 mm, still more specifically about 1.9 to 2.4 mm; and the frequency of occurrence of the ridges in the cross-machine direction of the fabric is from about 0.5 to 8 per centimeter, more specifically about 3.2 to 7.9, still more specifically about 4.2 to 5.3 per centimeter.

In other instances the three-dimensional fabrics may have textured sheet-contacting surfaces that are waffle-like in structure, such as those disclosed in U.S. Pat. No. 7,300,543, the contents of which are incorporated herein in a manner consistent with the present disclosure. For example, the three-dimensional fabrics may have deep, discontinuous pocket structures with a regular series of distinct, relatively large depressions surrounded by raised warp or raised shute strands. The pockets could be of any shape, with their upper edges on the pocket sides being relatively even or uneven, but the lowest points of individual pockets are not connected to the lowest points of other pockets. The most common examples are all waffle-like in structure and could be warp dominant, shute dominant, or coplanar. The pocket depths can be from about 250 to about 525 percent of the warp strand diameter.

In still other instances the three-dimensional fabrics may have textured sheet-contacting surfaces formed by a non-woven material bonded to a woven support structure. For example, the three-dimensional fabric may comprise a framework of protuberances joined to a reinforcing structure and extending outwardly therefrom to define deflection conduits between the protuberances, such as that disclosed in U.S. Pat. No. 5,628,876, the contents of which are incorporated herein in a manner consistent with the present disclosure. The framework of protuberances comprises a continuous or semicontinuous pattern and may have a height from about 0.10 to about 3.00 mm, such as from about 0.50 to about 1.00 mm. Alternatively, the fabric may comprise a plurality of parallel, spaced apart and substantially rectangular polymeric protuberances such as those disclosed in U.S. Pat. No. 9,512,572, the contents of which are incorporated herein in a manner consistent with the present disclosure. In such instances the protuberances may be similarly sized and have generally straight, parallel sidewalls with substantially equal height and width, which may range from about 0.5 to about 1.00 mm.

In particularly preferred embodiments the tissue products of the present invention are produced using a noncompressive drying method which tends to preserve, or increase, the caliper or thickness of the wet web including, without limitation, through-air drying, infra-red radiation, microwave drying, etc. Because of its commercial availability and practicality, through-air drying is well-known and is a preferred means for noncompressively drying the web for purposes of this invention. The through-air drying process and tackle can be conventional as is well known in the papermaking industry. In certain instances it may be preferable to use a through-air drying fabric having a web contacting surface with three-dimensional topography as described above. After manufacture the web may be subsequently converted, as is well known in the art, by processes such as calendering, embossing, printing, lotion treating, slitting, cutting, folding, and packaging. Particularly preferred are processes that apply a plurality of embossments to at least one surface of the tissue web, as will be discussed in more detail below.

In one embodiment of the present invention, the tissue product has a plurality of embossments. In one embodiment the embossment pattern is applied only to the first ply, and therefore, each of the two plies serve different objectives and are visually distinguishable. For instance, the embossment pattern on the first ply provides, among other things, improved aesthetics regarding thickness and quilted appearance, while the second ply, being unembossed, is devised to enhance functional qualities such as absorbency, thickness and strength. In another embodiment the fibrous structure product is a two-ply product wherein both plies comprise a plurality of embossments. Suitable means of embossing include, for example, those disclosed in U.S. Pat. Nos. 5,096,527, 5,667,619, 6,032,712 and 6,755,928.

In a particularly preferred embodiment a multi-ply embossed tissue product according to the present invention may be manufactured using the apparatus shown in FIG. 1A. To produce the embossed tissue product 60, a first tissue ply 20 is conveyed past a series of idler rollers 22 towards the nip 24 that is located between an engraved roll 26 and an impression roll 28. The engraved roll 26 rotates in the counterclockwise direction while the impression roll 28 rotates in the clockwise direction. The first tissue ply 20 forms the top ply in the resulting embossed multi-ply tissue product 60.

The engraved roll 26 is generally a hard and non-deformable roll, such as a steel roll. The impression roll 28 may be a substantially smooth roll and more preferably a smooth roll having a covering, or made of, natural or synthetic rubber, for example, polybutadiene or copolymers of ethylene and propylene or the like. In a preferred embodiment, the impression roll 28 has a hardness greater than about 40 Shore (A), such as from about 40 to about 100 Shore (A) and more preferably from about 40 to about 80 Shore (A). By providing a receiving roll with such hardness, the designs of the engraved roll are not pressed into the impression roll as deep as in conventional apparatuses.

The impression roll 28 and engraved roll 26 are urged together to form a nip 24 through which the web 20 passes to impose an embossed pattern on the web. The engraved roll 26 comprises a plurality of protuberances 30, also referred to as embossing elements, extending radially therefrom. The protuberances are arranged so as to form a first embossing pattern. The protuberances 30 may have a height greater than about 1.30 mm, such as from about 1.30 to about 1.50 mm and more preferably from about 1.35 to about 1.45 mm. Typically the engraved roll will include many more protuberances than that shown in FIG. 1A. Further, the engraved roll may include additional protuberances forming a second or third embossing pattern.

With continued reference to FIG. 1A, force or pressure is applied to one or both of the rolls 26, 28, such that the rolls 26, 28 are urged against one another to form a nip 24 there-between. The pressure will cause the impression roll 28 to deform about the protuberances 30 such that when the web 20 is pressed about the protuberances 30 and onto the landing areas 31 (i.e. the outer surface areas of the roll surrounding the protuberances) an embossment 65 results (illustrated in FIG. 1B).

To form a two-ply tissue product, a second tissue ply 40 is conveyed around an idler roller 42 and is then passed into a nip 44 located between a substantially smooth roll 46 which may be made of rubber and a marrying roll 48, which may be a steel roll. The second tissue ply 40 is adapted to form the bottom ply in the resulting multi-ply tissue product 60. As it is conveyed, the second tissue ply 40 passes through a second nip 50 created between the engraved roll 26 and the marrying roll 48 where it is brought into contact with the first tissue ply 20, which now bears an embossment 65 as a result of being embossed by the engraved roll 26. The first and second plies 20, 40 are joined together as they pass through the nip 50 to form a multi-ply tissue product 60.

With continued reference to FIG. 1A, in certain embodiments, after the first tissue ply 20 passes through the nip 24 between the engraved roll 26 and the impression roll 28, a gluing unit 52 applies glue to the distal ends of the embossments 65 (illustrated in detail in FIG. 1B) that are formed on the exterior surface of the embossed first tissue ply 20 by virtue of embossing by the first protuberances 30. The embossed first tissue ply 20 with the applied glue then advances further to a nip 50 between the engraved roll 26 and the marrying roll 48. At this point, the unembossed second ply 40 is attached to the embossed first ply 20 and are then conveyed around a marrying roll 48 to form a two-ply tissue product 60 which is subsequently wound into a roll (not shown).

Figure 1B:
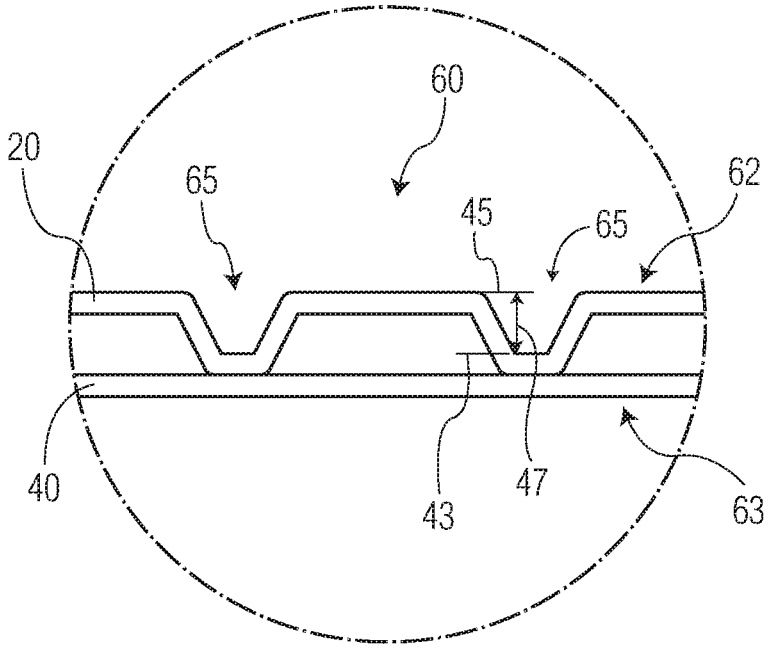

As illustrated in FIG. 1B, the resulting two-ply tissue product 60 comprises the first and second plies 20, 40, where the first ply 20, which forms the top ply of the tissue product 60, bears an embossment 65, but the second ply 40 has not been heavily embossed and generally does not have a distinct embossment. Thus, in this manner, the first tissue ply 20 is embossed whereas the second ply 40 is unembossed. The degree to which the first tissue ply 20 is embossed can be achieved in several ways. For example, the impression roll 28 can be made of materials having different degrees of softness to allow a higher penetration depth of the first and second protuberances 30, 32. Alternatively the pressure at the nip 24 between the engraved roll 26 and the impression roll 28 may be varied.

With further reference to FIG. 1B, the product 60 has an upper surface 62 and an opposite lower surface 63 wherein the embossments 65 are generally formed along the upper surface 62. The embossments 65 are generally in the form of a depression below the surface plane 45 of the upper surface 62. The embossment 65 may have a depth 47, which is generally measured between the upper surface plane 45 of the product 60 and the embossment 65 bottom plane 43.

The tissue webs prepared as described herein may be incorporated into a multi-ply tissue product, such as a product comprising two, three or four plies. The individual plies may be joined together using well known techniques such as with a laminating adhesive to hold the plies together. In particularly preferred instances the plies may be combined using an embossing-lamination assembly that uses both mechanical and adhesive means to join the plies. For example, the plies may be embossed and joined together using at least one steel embossing roller, at least one rubber-coated embossing counter-roller, and at least one roller for distribution of an adhesive, which may be applied to the tissue web after it exits the pair of embossing rollers.

After plying, the tissue product may be further converted by slitting, perforating, cutting and/or winding. For example, the tissue product may be in roll form where sheets of the embossed tissue product are convolutedly wrapped about themselves, with or without the use of a core.

Generally the tissue products of the present invention comprises cellulosic fibers. Suitable cellulosic fibers for use in connection with this invention include secondary (recycled) papermaking fibers and virgin papermaking fibers in all proportions. Such fibers include, without limitation, hardwood and softwood fibers as well as nonwoody fibers. Noncellulosic synthetic fibers can also be included as a portion of the fiber furnish. In certain preferred instances the tissue products of the present invention comprises cellulosic pulp fibers such as a blend of hardwood kraft pulp fibers and softwood kraft pulp fibers. However, cellulosic pulp fibers derived from other wood and non-wood sources, such as cereal straws (wheat, rye, barley, oat, etc.), stalks (corn, cotton, sorghum, Hesperaloe funifera, etc.), canes (bamboo, bagasse, etc.) and grasses (esparto, lemon, sabai, switchgrass, etc.), may be present in the tissue products of the present invention.

Tissue webs prepared according to the present disclosure can be layered or non-layered (blended). Layered sheets can have two, three or more layers. For tissue sheets that will be converted into a multi-ply product it can be advantageous to form the product from plies having at least two layers such that when the layers are brought into facing arrangement with each other the outer layers comprise primarily hardwood fibers and the inner layers comprise primarily softwood fibers. Tissue sheets in accordance with this invention would be suitable for all forms of tissue products including, but not limited to, bathroom tissue, kitchen towels, facial tissue and table napkins for consumer and services markets.

In one instance the invention provides an embossed tissue product comprising a through-air dried tissue product, which may be creped or uncreped. In one example, the tissue product comprises two or more tissue webs that have been wet-laid, through-air dried and are uncreped. After the tissue web is manufactured two separate webs are laminated and embossed such that the resulting tissue product consists essentially of a first ply and a second ply, where the first ply forms the first upper surface of the tissue product and has a plurality of embossments disposed thereon.

Figure 3:
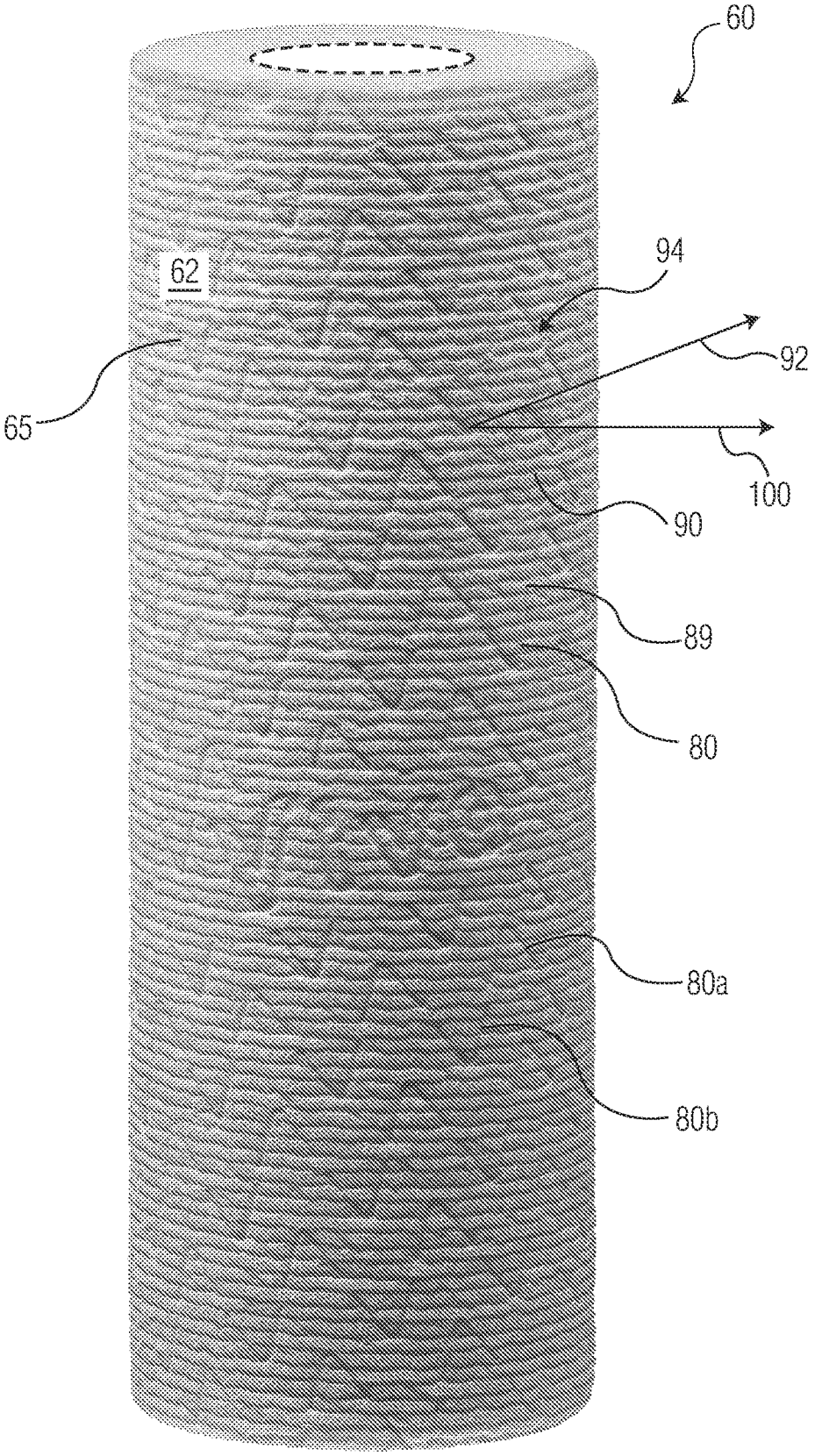
FIG. 3 is a perspective view of a tissue product.
Figure 4:
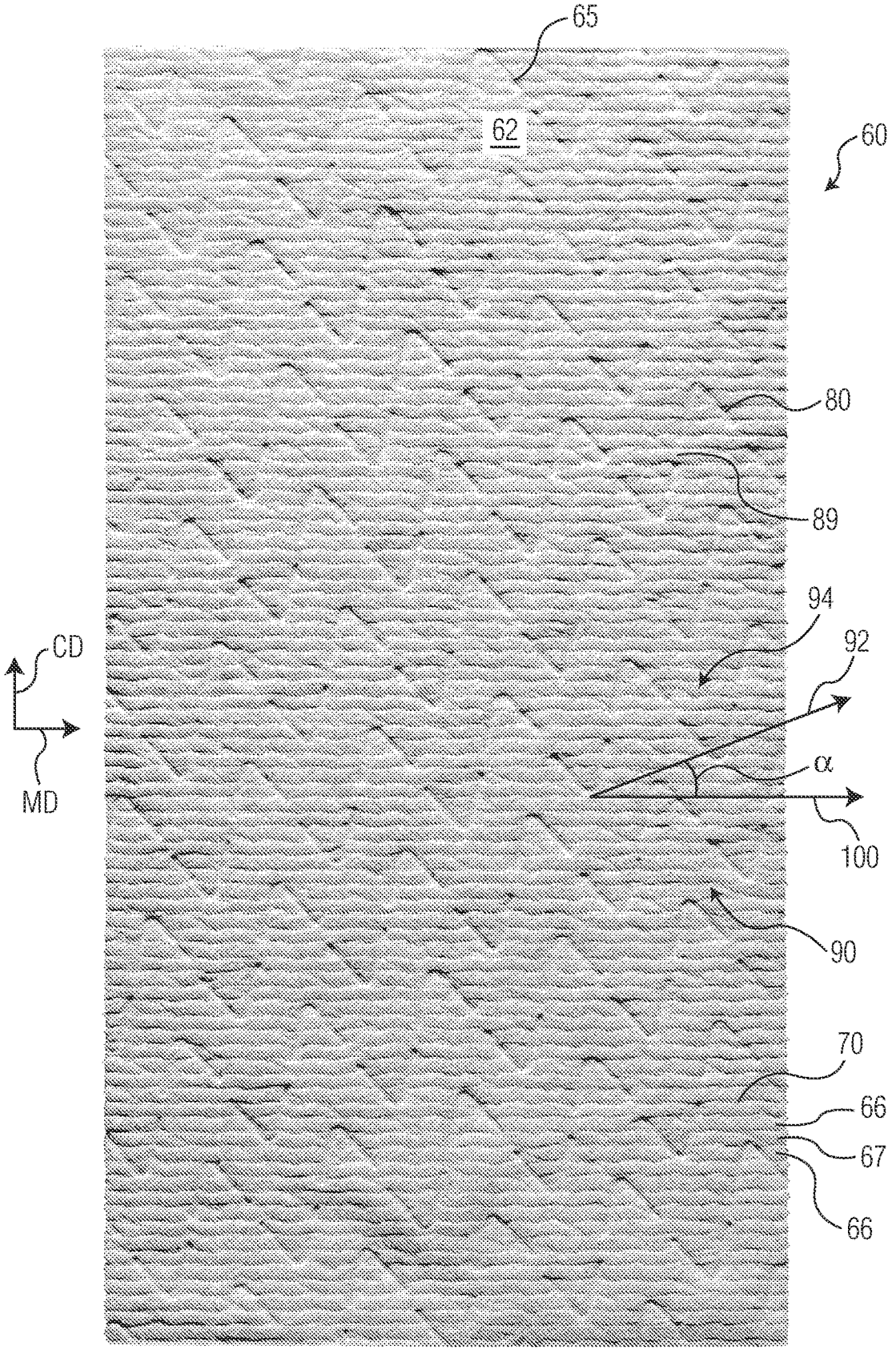
FIG. 4 is a top plane view of a tissue product.

Tissue products of the present invention are preferably embossed. In one example, as illustrated in FIGS. 3 and 4, the tissue product 60 comprises a plurality of embossments 65, which in the illustrated embodiment are discrete and non-linear. The embossed area may be about 15 percent or less, such as 12 percent or less, such as 10 percent or less, such as from about 4 to about 10 percent or from about 5 to about 8 percent.

With continued reference to FIGS. 3 and 4, the embossing pattern 90 comprises a plurality of embossments 65 that consist entirely of non-linear line elements 80 and is substantially free from dot embossments. In such instances the line elements may make up 100 percent of the embossed area. In other instances at least about 90 percent, such as at least about 92 percent, such as at least about 94 percent, of the embossed area consists of line elements and more preferably non-linear line elements.

In addition to the plurality of embossments 65, the tissue product 60 has a first surface 62 comprising a plurality of substantially machine direction (MD) oriented ridges 66 that are spaced apart from one another and define valleys 67 there between. The plurality of substantially machine direction oriented ridges 66 are generally linear elements that form a background pattern 70 over which an embossing pattern 90 is applied. The non-linear embossed elements 80 that make up the embossing pattern 90 periodically interrupt the substantially machine direction oriented ridges 66. The substantially machine direction oriented ridges 66 may be spaced apart from one another such that the background pattern 70 comprise 10 or more ridges every 10 cm, such as from 10 to about 60 ridges every 10 cm, such as from about 30 to about 50 ridges every 10 cm, as measured along the cross-machine direction axis.

While the background pattern 70 illustrated in FIGS. 3 and 4 consists of linear, substantially machine direction oriented ridges 66, the invention is not so limited. In other instances the background pattern may consist of line elements that are non-linear. For example, the background pattern may consists of line elements that zig-zag or are curvilinear. In particularly preferred instances the background pattern comprises a plurality of elements, whether linear or non-linear elements, that are arranged parallel to one another such that the elements do not intersect one another.

The embossing pattern 90 generally overlays the background pattern 70 of MD ordinated ridges 66 and has a principle axis of orientation 92 that is oriented at an angle (a) relative to the MD axis 100. In certain instances the embossing pattern may be arranged at an angle relative to the MD axis (angle, a) such as from about 10 to about 40 degrees, such as from about 15 to about 35 degrees.

In a particularly preferred embodiment, such as that illustrated in FIGS. 3 and 4, the embossments 65 may be in the form of discrete, non-linear elements 80 that form recognizable shapes, such as a V-shape. The non-linear elements 80 may be arranged into motifs 94 that may be further arranged to form a pattern 90, such as the illustrated chevron pattern. While in certain embodiments the embossments may form recognizable shapes, such as letters or geometric shapes, such as a triangle, diamond, trapezoid, parallelogram, rhombus, star, pentagon, hexagon, octagon, or the like, the invention is not so limited. In other embodiments the embossments may comprise non-linear elements which are arranged, but do not form a recognizable geometric shape.

Just as the shape of the embossment may vary, their size may also be varied. In certain instances the embossments may comprise a plurality of non-linear elements having a length (L) of about 20.0 mm or greater, such as about 25.0 mm or greater, such as about 30.0 mm or greater, such as from about 20.0 to about 60.0 mm. The width of the non-linear embossed elements may be less than about 2.0 mm, such as less than about 1.5 mm, such as less than about 1.0 mm, such as from about 0.20 to about 2.0 mm, such as from about 0.50 to about 1.50 mm. The width of a non-linear embossed element may be uniform along its length or it may vary. In those instances where the width varies, it may be preferable that it vary less than about 1.0 mm. For example, the element may have a first width of about 0.5 to about 0.75 mm and a second width from about 1.0 to about 1.5 mm.

Figure 5A:
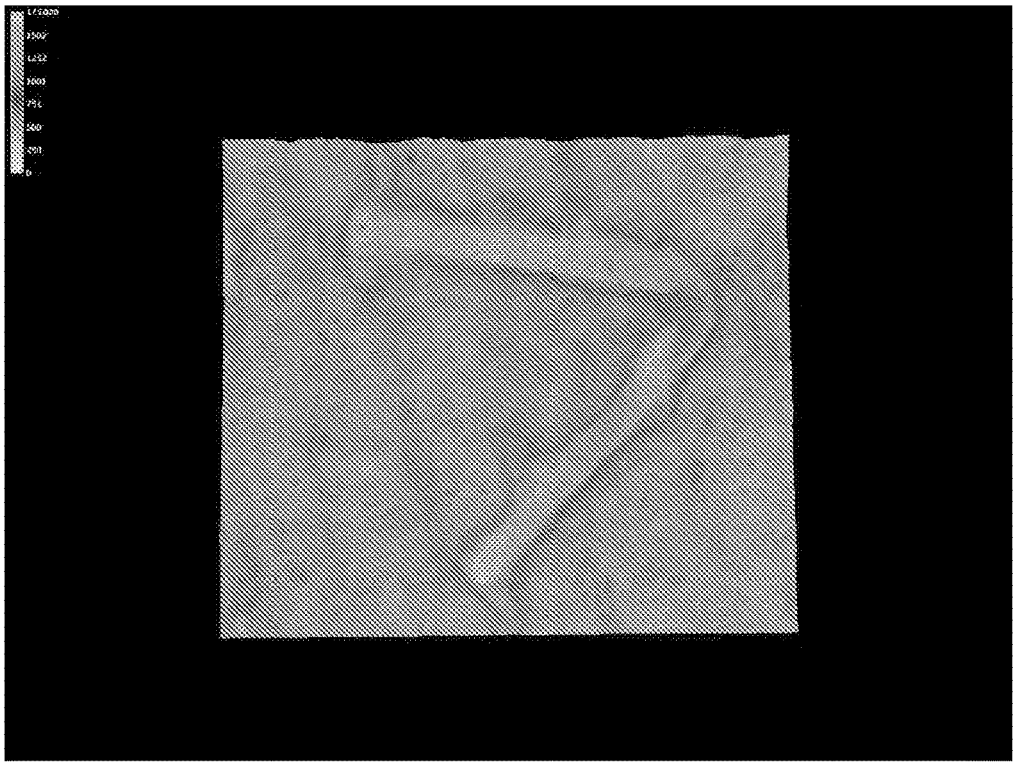
FIGS. 5A and 5B are 3-D images and a cross sectional profile of a tissue product obtained using Keyence Microscope and imaging software as described herein
Figure 5B:
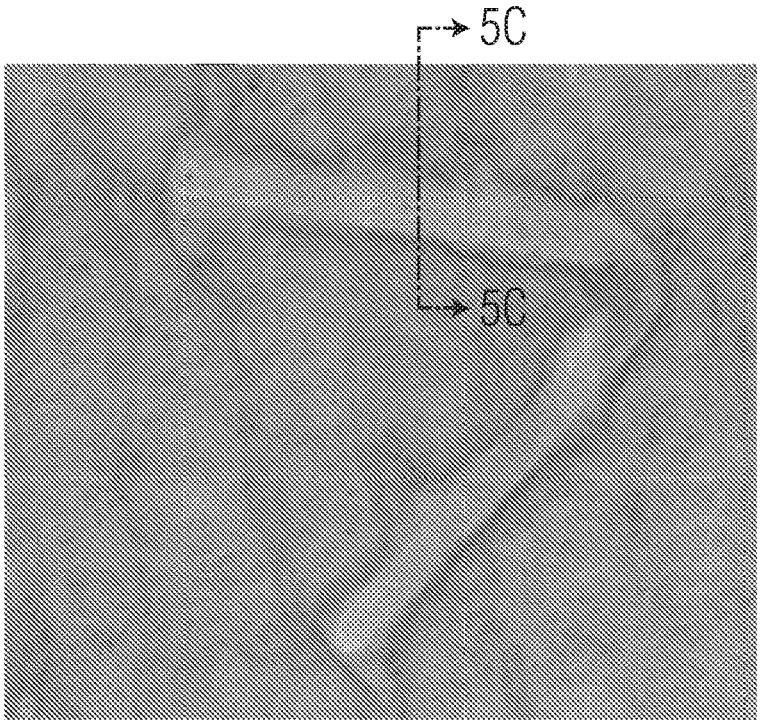
Figure 5C:
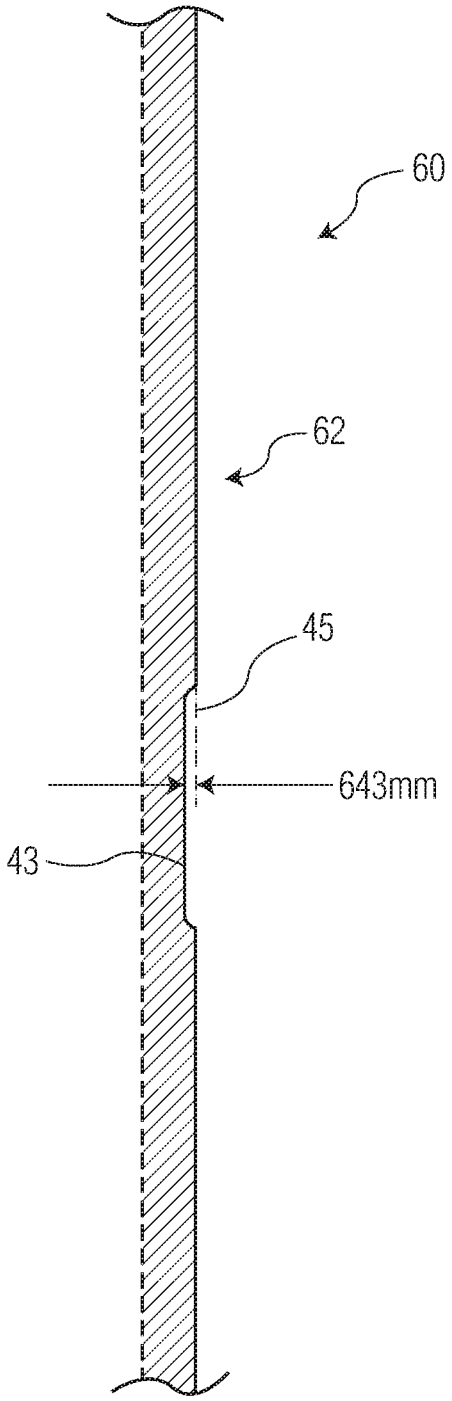
FIG. 5C illustrates a cross section of a tissue product.

The embossed elements may exhibit any suitable height known to those of skill in the art. For example, an embossed elements may exhibit a height of greater than about 0.10 mm and/or greater than about 0.20 mm and/or greater than about 0.30 mm to about 3.60 mm and/or to about 2.75 mm and/or to about 1.50 mm. Generally the embossment height is measured from the upper most surface plane of the tissue product and the embossment bottom plane using Keyence Microscope and imaging software as described herein. Exemplary measurements of embossment height are illustrated in FIGS. 5A-5C.

Compared to prior art commercial two-ply, embossed, towel products, tissue products prepared according to the present invention generally have low stiffness, measured as Flexural Rigidity, even at relatively high basis weights, such as greater than about 45 gsm, more preferably greater than about 47 gsm and still more preferably greater than about 50 gsm, such as from about 45 to about 65 gsm, such as from about 50 to about 60 gsm and more preferably from about 50 to about 55 gsm. Table 1, below, compares the Flexural Rigidity of an inventive tissue product to the Flexural Rigidity of prior art multi-ply, embossed tissue products.

TABLE 1

| Product | Embossed | Plies | BW (gsm) | GMT (g/3") | MD Flexural Rigidity (mg*cm) | CD Flexural Rigidity (mg*cm) | Total Flexural Rigidity (mg*cm) | GM Flexural Rigidity (mg*cm) | Flexural Rigidity MD:CD Ratio |
|---|---|---|---|---|---|---|---|---|---|
| Inventive | Y | 2 | 52.0 | 3160 | 831 | 372 | 570 | 556 | 2.23 |
| Sparkle ® Paper Towels | Y | 2 | 45.1 | 3692 | 569 | 1717 | 1039 | 988 | 0.33 |
| Brawny ® Paper Towels | Y | 2 | 49.9 | 3521 | 944 | 1597 | 1242 | 1228 | 0.59 |
| Bounty ™ Paper Towels | Y | 2 | 51.0 | 3955 | 608 | 1682 | 1055 | 1011 | 0.36 |
| Bounty ™ Essentials Paper Towels | Y | 2 | 36.5 | 3626 | 299 | 339 | 318 | 318 | 0.88 |

Accordingly, in certain embodiments the present invention provides a multi-ply embossed tissue product having a basis weight greater than about 45 gsm, such as from about 45 to about 65 gsm, such as from about 50 to about 60 gsm, and more preferably from about 50 to about 55 gsm, and a GM Flexural Rigidity less than about 600 mg*cm and more preferably less than about 575 mg*cm and still more preferably less than about 560 mg*cm, such as from about 450 to about 600 mg*cm and still more preferably from about 500 to about 560 mg*cm. As such the inventive multi-ply embossed tissue products are of sufficient basis weight to have good substance in hand, yet have relatively low stiffness so as to have good handfeel and not be overly rigid.

In other embodiments the present invention provides a multi-ply embossed tissue product having relatively low CD Flexural Rigidity, particularly in relation to MD Flexural Rigidity. As such, in certain embodiments, the inventive tissue products have particularly good drapability in the cross-machine direction and good handfeel. For example, the present tissue products may be embossed and comprise two or more plies and may have a CD Flexural Rigidity less than about 400 mg*cm, and more preferably less than about 380 mg*cm and still more preferably less than about 375 mg*cm, such as from about 300 to about 400 mg*cm and more preferably from about 350 to about 375 mg*cm. The foregoing tissue products may have MD Flexural Rigidity that is greater than CD Flexural Rigidity such that the ratio of MD Flexural Rigidity to CD Flexural Rigidity is greater than about 1.0. In particularly preferred instances tissue products prepared according to the present invention have a ratio of MD Flexural Rigidity to CD Flexural Rigidity that is greater than about 1.5 and still more preferably greater than about 2.0, such as from about 1.0 to about 3.0, and more preferably from about 1.5 to about 2.5, such as from about 2.0 to about 2.5.

The inventive tissue products may also have improved wet performance, particularly wet resiliency. Typically, wet resiliency is characterized herein as the wet elastic strain ratio and is a measurement of the elastic strain to the applied strain when the tissue product is compressed under a specified load. The wet elastic strain ratio will range between one for a completely elastic solid with no plastic deformation, to zero for a perfectly plastic solid with no elastic recovery. Ideally a tissue product, particularly towel products, will be very elastic when wet so that when the product is wetted in use and then wrung out it will rebound to its original thickness. By rebounding to its original thickness the product retains its void volume and may be used to absorb another spill. Accordingly, in certain embodiments, the tissue products of the present invention have a wet elastic strain ratio greater than about 32 percent and more preferably greater than about 34 percent and still more preferably greater than about 36 percent, such as from about 32 to about 40 percent, such as from about 34 to about 40 percent. The wet elastic strain ratio of various prior art tissue products and an inventive tissue product are provided in Table 2, below.

TABLE 2

| | Inventive | Brawny ® Paper Towels | Bounty ™ Paper Towels |
|---|---|---|---|
| $C1_5$ (mm) | 1.344 | 0.870 | 1.220 |
| $C1_{300}$ (mm) | 0.340 | 0.337 | 0.437 |
| $C2_5$ (mm) | 0.563 | 0.454 | 0.590 |
| $C2_{300}$ (mm) | 0.327 | 0.324 | 0.423 |
| $C3_5$ (mm) | 0.508 | 0.425 | 0.548 |
| $C3_{300}$ (mm) | 0.320 | 0.317 | 0.416 |
| Wet Elastic Strain Ratio | 36.6% | 31.3% | 29.2% |

In addition to having improved stiffness and wet resiliency, the present tissue products may also have improved absorption properties. For example, the present tissue products are capable of absorbing a larger percentage of a liquid spill and retaining the absorbed spill better than prior art tissue products. Accordingly, in certain embodiments, the invention provides a multi-ply embossed tissue product having a Residual Water ($W_{Residual}$) value less than about 0.15 g, such a less than about 0.12 g, such as less than about 0.10 g, such as from about 0.05 to about 0.15 g and more preferably from about 0.05 to about 0.10 g. In a particularly preferred embodiment the present invention provides a two-ply through-air dried embossed tissue product having a basis weight from about 50 to about 55 gsm and a GMT from about 2,000 to about 4,000 g/3" and a Residual Water value from about 0.05 to about 0.15 and more preferably from about 0.05 to about 0.10 g.

Not only do the inventive tissue products absorb more of a liquid spill initially, more of the spill is retained by the product over time compared to other prior art tissue products. For example, in one embodiment, the invention provides a multi-ply embossed tissue product having a Drip Time (DT) greater than about 20 seconds, such as greater than about 30 seconds, such as greater than about 45 seconds. In certain preferred embodiments the tissue product is essentially dripless; that is, the tissue product does not drip any fluid in the Drip Test, described below in the Test Methods section. In a particularly preferred embodiment the present invention provides a two-ply through-air dried embossed tissue product having a basis weight from about 50 to about 55 gsm and a GMT from about 2,000 to about 4,000 g/3" and a Drip Time greater than about 30 seconds and more preferably greater than about 45 seconds.

The absorption properties of tissue products prepared according invention compared to those of the prior art are further detailed in Table 3, below.

TABLE 3

| Product | TAD | Em-bossed | Plies | BW (gsm) | $W_I$ (g) | $W_{Residual}$ (g) | $W_D$ (g) | DT (sec.) | $W_{Retained}$ (g) | Liquid Absorbed and Retained (%) | Absorbed Liquid Retention (%) |
|---|---|---|---|---|---|---|---|---|---|---|---|
| Inventive 1 | Y | Y | 2 | 52.0 | 5.02 | 0.08 | 0.00 | >60 | 4.94 | 98.4% | 100.0% |
| Inventive 2 | Y | Y | 2 | 51.8 | 5.01 | 0.09 | 0 | >60 | 4.920 | 98.3% | 100.0% |
| Inventive 3 | Y | Y | 2 | 50.1 | 5.01 | 0.07 | 0 | >60 | 4.936 | 98.5% | 100.0% |
| Sparkle ® Paper Towels | N | Y | 2 | 45.1 | 5.00 | 0.62 | 1.17 | 3 | 3.21 | 64.2% | 73.4% |
| Great Value ™ Everyday Strong ™ Paper Towels | N | Y | 2 | 37.1 | 5.01 | 0.86 | 1.44 | 2 | 2.72 | 54.2% | 65.4% |
| Fiora ® Paper Towels | N | Y | 3 | 41.0 | 5.02 | 0.57 | 1.21 | 3 | 3.24 | 64.6% | 72.8% |
| Great Value ™ Ultra Strong Paper Towels | Y | Y | 2 | 45.4 | 5.03 | 0.33 | 0.58 | 6 | 4.12 | 82.0% | 87.7% |
| Presto ® Paper Towels | Y | Y | 2 | 40.6 | 5.02 | 0.28 | 0.29 | 7 | 4.44 | 88.6% | 93.9% |
| Brawny ® Paper Towels | Y | Y | 2 | 49.9 | 5.03 | 0.22 | 0.28 | 12 | 4.53 | 90.1% | 94.2% |
| Bounty ™ Essentials Paper Towels | Y | Y | 2 | 36.5 | 5.02 | 0.24 | 0.67 | 6 | 4.11 | 81.9% | 86.0% |
| Bounty ™ Paper Towels | Y | Y | 2 | 51.0 | 5.01 | 0.15 | 0.20 | 18 | 4.66 | 93.0% | 95.8% |
| Bounty ™ DuraTowel ® | Y | Y | 2 | 58.8 | 5.02 | 0.16 | 0.17 | 19 | 4.69 | 93.5% | 96.5% |
| Scottex ® Tuttofare | Y | Y | 2 | 32.9 | 5.00 | 0.25 | 0.71 | 2 | 4.04 | 80.8% | 85.1% |
| Viva ® Vantage ® Paper Towel | Y | N | 1 | 54.3 | 5.02 | 0.26 | 0.05 | 43 | 4.71 | 93.8% | 99.0% |
| Viva ® Paper Towel | Y | N | 1 | 57.7 | 5.02 | 0.12 | 0.00 | >60 | 4.90 | 97.6% | 100.0% |

In other instances the tissue products prepared according to the present invention absorb more of a liquid spill initially and then retain more of the absorbed spill over time. For example, the amount of a liquid spill that is absorbed and retained by the tissue product over a period of time, referred to herein as the Liquid Absorbed and Retained rate and calculated as:

$$\text{Liquid Absorbed and Retained } (\%) = \frac{W_{Retained}}{W_I} \times 100$$

may be greater than about 94 percent, such as greater than about 95 percent, such as greater than about 96 percent, such as from about 95 to about 99 percent.

In still other instances the inventive tissue products retain a greater percentage of absorbed liquid spill over time and as such have an improved Absorbed Liquid Retention Rate, calculated as:

$$\text{Absorbed Liquid Retention Rate } (\%) = \frac{W_{Retained}}{(W_I - W_{Residual})} \times 100$$

greater than about 98 percent, such as greater than about 99 percent, such as about 100 percent. As a greater percentage of the absorbed spill is retained by the inventive tissue products, the products generally have a relatively low Discharge Weight ($W_D$), such as less than about 0.10 g, such as less than about 0.08 g, such as less than about 0.05 g, such as from about 0.0 to about 0.10 g.

Each of the forgoing absorption improvements of the inventive tissue products are measured according to the Drip Test, as set forth in the Test Methods section below.

Test Methods

The following test methods are to be conducted on samples that have been in a TAPPI conditioned room at a temperature of 73.4±3.6° F. (about 23±2° C.) and relative humidity of 50±5 percent for 4 hours prior to the test.

Tensile

Tensile testing was done in accordance with TAPPI test method T-576 "Tensile properties of towel and tissue products (using constant rate of elongation)" wherein the testing is conducted on a tensile testing machine maintaining a constant rate of elongation and the width of each specimen tested is 3 inches. More specifically, samples for dry tensile strength testing were prepared by cutting a 3±0.05 inches (76.2 mm±1.3 mm) wide strip in either the machine direction (MD) or cross-machine direction (CD) orientation using a JDC Precision Sample Cutter (Thwing-Albert Instrument Company, Philadelphia, PA, Model No. JDC 3-10, Serial No. 37333) or equivalent. The instrument used for measuring tensile strengths was an MTS Systems Sintech 11S, Serial No. 6233. The data acquisition software was an MTS TestWorks® for Windows Ver. 3.10 (MTS Systems Corp., Research Triangle Park, NC). The load cell was selected from either a 50 Newton or 100 Newton maximum, depending on the strength of the sample being tested, such that the majority of peak load values fall between 10 to 90 percent of the load cell's full scale value. The gauge length between jaws was 4±0.04 inches (101.6±1 mm) for facial tissue and towels and 2±0.02 inches (50.8±0.5 mm) for bath tissue. The crosshead speed was 10±0.4 inches/min (254±1 mm/min), and the break sensitivity was set at 65 percent. The sample was placed in the jaws of the instrument, centered both vertically and horizontally. The test was then started and ended when the specimen broke. The peak load was recorded as either the "MD tensile strength" or the "CD tensile strength" of the specimen depending on the direction of the sample being tested. Ten representative specimens were tested for each product or sheet and the arithmetic average of all individual specimen tests was recorded as the appropriate MD or CD tensile strength of the product or sheet in units of grams of force per 3 inches of sample. The geometric mean tensile (GMT) strength was calculated and is expressed as grams-force per 3 inches of sample width. Tensile energy absorbed (TEA) and slope are also calculated by the tensile tester. TEA is reported in units of gm·cm/cm$^2$. Slope is recorded in units of grams (g) or kilograms (kg). Both TEA and Slope are directionally dependent and thus MD and CD directions are measured independently. Geometric mean TEA and geometric mean slope are defined as the square root of the product of the representative MD and CD values for the given property.

Flexural Rigidity

This test is performed on 1 inch×6 inch (2.54 cm×15.24 cm) strips of tissue product sample. The tissue products to be tested should be free from creases, bends, folds, perforations and defects. A Cantilever Bending Tester such as described in ASTM Standard D 1388 (Model 5010, Instrument Marketing Services, Fairfield, NJ) is used and operated at a ramp angle of 41.5+0.5 degrees and a sample slide speed of 120 mm/minute.

This test sequence is performed a total of eight (8) times for each tissue product in each direction (MD and CD) using a new test piece for each measurement. The first four strips are tested with the upper surface as the tissue product was cut facing up. The last four strips are inverted so that the upper surface as the tissue product was cut is facing down as the strip is placed on the horizontal platform of the Tester. The average overhang length is determined by averaging the sixteen (16) readings obtained on a tissue product.

Overhang Length MD=Sum of 8 MD readings

Overhang Length CD=Sum of 8 CD readings

Overhang Length Total=Sum of all 16 readings

Bend Length MD=Overhang Length MD

Bend Length CD=Overhang Length CD

Bend Length Total=Overhang Length Total

Flexural Rigidity=$0.1629 \times W \times C^3$

Where W is the basis weight of the tissue product in lbs/3000 $ft^2$; C is the bending length (MD or CD or Total) in cm; and the constant 0.1629 is used to convert the basis weight from English to metric units. The results are expressed in mg*cm2/cm.

$$\text{GM Flexural Rigidity}=\sqrt{\text{MD Flexural Rigidity} \times \text{CD Flexural Rigidity}}$$

Drip Test

Tissue product samples to be tested are cut to a size of 5 inches×5 inches using a die paper cutter to ensure straight edges, from the center of the sheet without touching any perforations. Any damaged or abnormal product, such as product that is creased, turned or crushed is discarded. A total of five (5) samples to be tested are prepared.

Two top loading balances are used with a minimum resolution of 0.01 g. The first top loading balance is fitted with a Formica tile of at least 7 inches×7 inches and tared to negate the weight of the tile. The second top loading balance is equipped with an apparatus for suspending a sample by a clip after it has been wetted, as described further below. The apparatus is arranged such that the sample is suspended by a clip twelve (12) inches over the second top loading balance. In addition, the second top loading balance is fitted with a plastic square 3.5 inch×3.5 inch×1 inch weigh boat. The balance is tared to negate the weight of the boat. The two balances are arranged directly next to each other to negate disturbances when moving a sample from the first balance to the clip above the second balance. In all instances weights are recorded when the readings on the top loading balance become constant.

To perform the test 5 mL of distilled water is measured using a pipette and dispensed onto the center of the Formica tile with care taken to ensure that the dispensed water is in the shape of a circle, no larger than a diameter of about 2 inches (about 5.0 cm). The weight of the water on the Formica tile is recorded in grams to the nearest hundredth ($W_I$). The sample is arranged such that the embossed side of the sheet, or the side facing the consumer on the outside of the roll, will face down when placed on the water. The center of the sample is placed directly on top of the water on the first top loading balance. Immediately upon the sample and water contacting one another a timer is started. After 15 seconds, the sample is carefully removed from the balance by peeling back the top right corner towards the tester. Immediately after the sample is lifted off the first balance, a timer is started. The amount of fluid remaining on the Formica tile, which was not absorbed by the sample, is recorded to the nearest hundredth of a gram. This value is the Residual Water ($W_{Residual}$) having units of grams.

Once the sample is lifted off the first balance it is transferred into the clip above the second balance, without disturbing the sample. A Boston Clip Number 1 with a 1.25 inch clip opening or similar is use to secure by clipping from 0.25 to 0.5 inches of the top right corner of the sample in the clip. In this manner the sample is suspended above the weigh boat on the second, tared, top loading balance. The test is concluded after 60 seconds have elapsed since the sample was clipped above the second balance.

When the sample first drips water onto the tared weigh boat on the second top loading balance the time is recorded. This is the Drip Time (DT), having units of seconds. If a sample does not drip during the 60 second test period its DT is recorded as >60 s. After a minute, the weight of the fluid that has been collected in the weigh boat on the second balance is recorded to the nearest hundredth of a gram. This mass is referred to the Discharge Weight ($W_D$), having units of grams.

Based upon the foregoing test method, the follow values are reported:

(1) Residual Water ($W_{Residual}$), having units of grams (g), which is the mass of water not absorbed by the sample on the first top loading balance;

(2) Drip Time (DT), having units of seconds (s), which is the time on the timer when the sample first drips water onto the tared weigh boat; and (3) Water Retained ($W_{Retained}$), having units of grams (g), which is the amount of water retained by the sample at the conclusion of the test method and is calculated as follows:

$$\text{Water Retained } (W_{Retained})(g)=(W_I(g)-W_{Residual}(g))-W_D(g).$$

The foregoing values are an average of five (5) replicates for each tissue product sample.

Wet Resiliency

Caliper versus load data are obtained using a Thwing-Albert Model EJA Materials Tester, equipped with a 50 N capacity load cell that was programmed to 45 N to prevent overloading. The instrument is run under the control of Thwing-Albert Motion Analysis Presentation Software (MAP). The instrument set up was as follows:

| Parameter | Value | Units |
|---|---|---|
| Test Speed | 0.100 | Inches/min. |
| Number of Cycles | 3 | |
| Max End Load | 300 | gf |
| Data Acquisition Rate | 10.0 | Hz |
| Top Platen Diameter | 28.65 | mm |
| Bottom Platen Diameter | 76.2 | mm |
| Load Limit | 45 | N |
| Platen Separation | 5.0 | mm |

A single sheet of a conditioned sample is cut to a diameter of approximately two inches. Care should be taken to avoid damage to the center portion of the sample, which will be under test. Scissors or other cutting tools may be used.

Testing is carried out under the same temperature and humidity conditions used to condition the samples.

For the test, the sample is centered on the compression table under the compression foot. Just before the test execution, the sample is saturated with 4.0 g water/g fiber. The compression-relaxation procedure is repeated 3 times on the same sample. The compression and relaxation data are obtained using a crosshead speed of 0.1 inches/minute. The deflection of the load cell is obtained by running the test without a sample being present. This is generally known as the Steel-to-Steel data. The Steel-to-Steel data are obtained at a crosshead speed of 0.005 inch/minute. Crosshead position and load cell data are recorded between the load cell range of 5 grams and 300 grams for both the compression and relaxation portions of the test. Since the foot area is one square inch this corresponded to a range of 5 grams/square inch to 300 grams/square inch. The maximum pressure exerted on the sample is 300 grams/square inch. At 300 grams/square inch the crosshead reverses its travel direction. Crosshead position values are collected at selected load values during the test. These correspond to pressure values of 5, 10, 25, 50, 75, 100, 125, 150, 200, 300, 200, 150, 125, 100, 75, 50, 25, 10, 5 grams/square inch for the compression and the relaxation direction.

During the compression portion of the test, crosshead position values are collected by the MAP software, by defining 10 traps (Trap1 to Trap 10) at load settings of C5, C10, C25, C50, C75, C100, C125, C150, C200, C300. During the return portion of the test, crosshead position values are collected by the MAP software, by defining ten return traps (Return Trap1 to Return Trap 10) at load settings of R300, R200, R150, R125, R100, R75, R50, R25, R10, R5. This cycle of compressions to 300 grams/square inch and return to 5 grams/square inch is repeated 3 times on the same sample without removing the sample. The 3 cycle compression-relaxation test is replicated 5 times for a given product using a fresh sample each time. The result is reported as an average of the 5 replicates. Again values are obtained for both the Steel-to-Steel and the sample. Steel-to-Steel values are obtained for each batch of testing. If multiple days are involved in the testing, the values are checked daily. The Steel-to-Steel values and the sample values are an average of four replicates (300 g).

Caliper values, having units of millimeters (mm), are obtained by subtracting the average Steel-to-Steel crosshead trap values from the sample crosshead trap value at each trap point.

Microscopy

Tissue products produced according to the present invention may be analyzed by microscopy as described herein. Particularly, the three-dimensional surface topography and embossments may be analyzed by generating and analyzing product 3-D surface maps and cross-sections, such as those illustrated in FIGS. 5A and 5B. The images are taken using a VHX-5000 Digital Microscope manufactured by Keyence Corporation of Osaka, Japan. The microscope is equipped with VHX-5000 Communication Software Ver 1.5.1.1. The lens is an ultra-small, high performance zoom lens, VH-Z20R/Z20T.

The tissue product sample to be analyzed should be undamaged, flat, and include representative embossments. A sample of tissue product approximately 4 inches×4 inches in size works well.

A three-dimensional image of the sample is obtained as follows:

1. Turn the digital microscope on, and follow standard procedures for XY stage Initialization [Auto]
2. Turn the microscope magnification to ×100.
3. Place the tissue product sample on the stage with the first embossments facing up toward the lens.
4. If the tissue product does not lie flat, place weights as needed along the perimeter to make tissue lie flat against the stage surface.
5. Use the focus adjustment to bring the tissue into sharp focus.
6. Select "Stitching" in the main menu. Select "3D stitching."
7. Set the stitching method by selecting "Stitch around the current position."
8. Select the Z set to set the upper and lower composition range. The upper limit should be set by going higher than the highest focal point that is clear. The lower limit should be set by going lower than the lowest focal point that is clear. After setting the upper and lower range, click OK.
9. Select "Start stitching," to begin acquisition of the image.
10. Select "complete" when the desired area has been imaged, then "Confirm stitching results."
11. In the 3D menu, select "Height/Color view" to identify embossments to measure.
12. In the 3D menu, select "Profile."
13. With the "Profile line" tab selected obtain a cross-section of the tissue sample identified in Step 11, select "Line" and using the cursor draw a line across the identified portion of the sample. The line should bisect at least two adjacent embossments. The peaks on the right and left side of the first embossments should be relatively planar (difference in height less than 10 percent).
14. Use the "Pt-Pt" vertical measurement tool to measure the embossment peak height. If the height difference between the peaks is more than 10 percent select another first embossment to measure. The height of the embossments may then be measured using the VHX-5000 Communication Software Ver 1.5.1.1.

The surface area of the tissue product covered by embossments was measured using a Keyence Microscope and image analysis software described above. An image of the tissue was acquired at a magnification of 20× and the image was stitched, as described above, to include at least one embossing motif in the field of view. A 3-D height/color image was created and saved.

The saved 3-D height/color image was opened in "2-D Playback" mode and the embossment area was measured by first selecting "Measure" from the on-screen menu, followed by selection of "Auto" area measurement, then the "Color" option was selected and a measurement was taken by clicking inside the embossment image colored region.

Once a measurement was taken the embossments, which are generally the lowest points in the height map image and below the surface plane of the tissue product, were filled using the "Fill" and "Eliminate Small Grains" features, followed by selecting a Shaping step. If there are areas of the embossment that needed to be filled in, or otherwise edited to create an accurate 2-D highlight of the embossments, an accurate area representation was created by selecting "Edit", "Fill." The results were than tabulated by selecting "Next" to proceed to the Result Display step where "Measure Result" was selected and the calculated Area Ratio Percent was displayed. The measurement was repeated for 3 distinct areas of the tissue product sample and an arithmetic average Area Ratio Percent of the measurements was reported as the Embossed Area.

EXAMPLES

Base sheets were made using a through-air dried papermaking process commonly referred to as "uncreped through-air dried" ("UCTAD") and generally described in U.S. Pat. No. 5,607,551, the contents of which are incorporated herein in a manner consistent with the present disclosure. Base sheets with a target bone dry basis weight of about 27 grams per square meter (gsm) and GMT of about 1,800 g/3" were produced. The base sheets were then converted and spirally wound into rolled tissue products as described in the present example.

In all cases the base sheets were produced from a furnish comprising northern softwood kraft (NSWK) and eucalyptus hardwood kraft (EHWK) using a layered headbox fed by three stock pumps such that the webs having three layers (two outer layers and a middle layer) were formed. The two outer layers comprised EHWK (each layer comprising 20 wt % of the tissue web) and the middle layer comprised NSWK (middle layer comprised 60 wt % of the tissue web). Strength was controlled via the addition of carboxymethylcellulose (CMC) and permanent wet strength resin, and/or by refining the furnish.

The tissue web was formed on a Voith Fabrics TissueForm V forming fabric, vacuum dewatered to approximately 25 percent consistency and then subjected to rush transfer at a rate of 24 percent when transferred to the transfer fabric. The transfer fabric was a Voith T807-5 (commercially available from Voith Paper, Inc., Appleton WI). The web was then transferred to a woven through-air drying fabric having a plurality of substantially machine direction (MD) oriented ridges spaced apart from one another approximately 3.5 mm. The MD ridges were substantially continuous in the MD of the fabric and woven in a parallel, spaced apart arrangement to define valleys there between, where the valleys have a depth of about 1.5 mm. Transfer to the through-drying fabric was done using vacuum levels of greater than 6 inches of mercury at the transfer. The web was then dried to approximately 98 percent solids before winding.

The base sheet, prepared as described above, was converted into a two-ply rolled towel product. Specifically, base sheet was calendered using a patterned steel roll and a 40 P&J polyurethane roll, substantially as described in U.S. Pat. No. 10,040,265, the contents of which are incorporated herein in a manner consistent with the present invention, at a load of 30 pli.

The calendered base sheet was then converted to a two-ply product by embossing and laminating substantially as illustrated in FIG. 1A. Various engraved rolls were evaluated to assess their effect on the resulting tissue product properties. The properties of the engraved rolls are summarized in Table 4, below. Where an embossing pattern comprised elements having more than one line element, the length of the longest line element is reported as the Maximum Line Element Length.

TABLE 4

Figure 6:
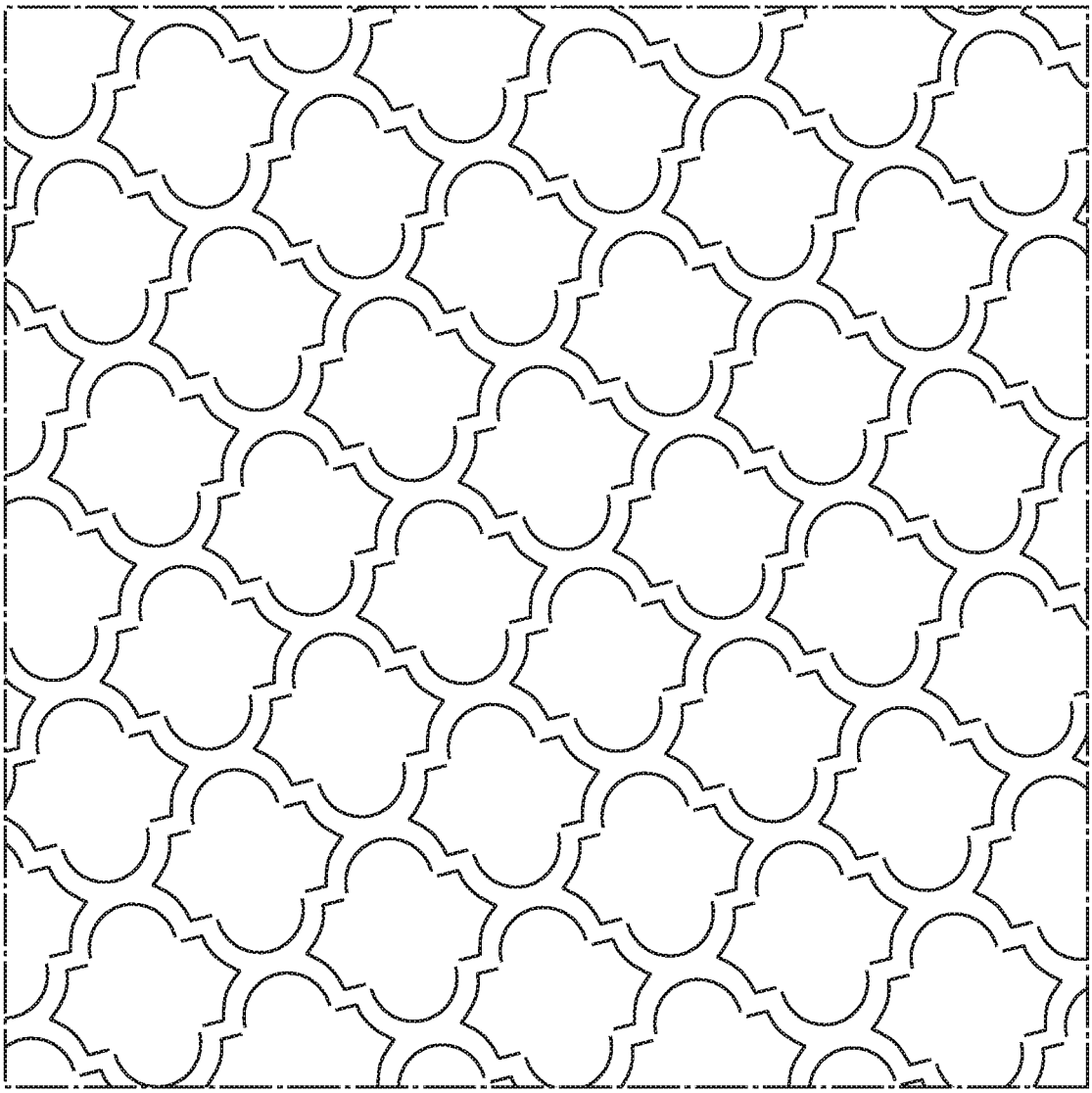
FIG. 6 illustrates an embossing pattern useful in the manufacture of tissue products according to the present invention.
Figure 7:
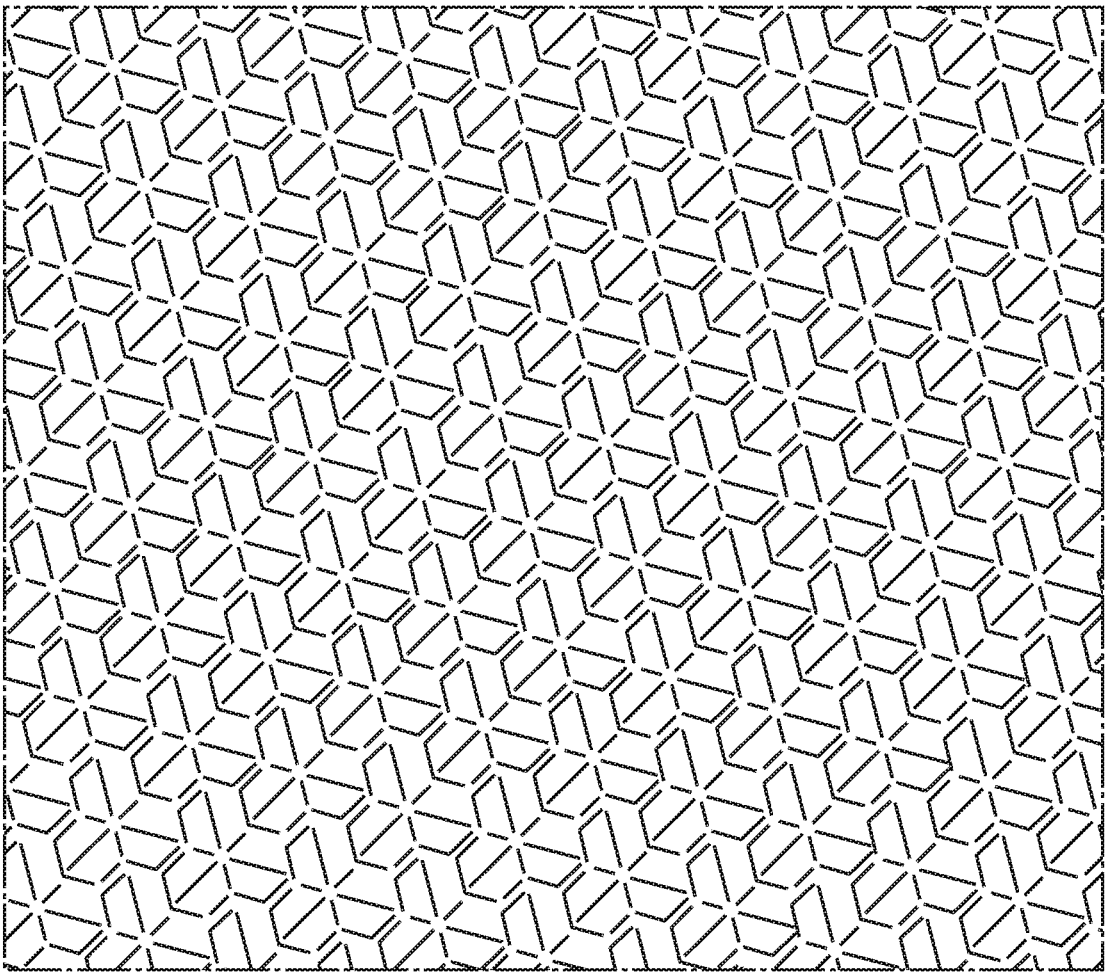
FIG. 7 illustrates another embossing pattern useful in the manufacture of tissue products according to the present invention.

| Inventive Sample | Embossing Motif | Discrete Non-Linear Line Elements | Maximum Line Element Length (mm) | Embossed Area (%) |
|---|---|---|---|---|
| Inventive 1 | FIG. 2 | Y | 24.5 | 6.7 |
| Inventive 2 | FIG. 6 | Y | 40.9 | 7.3 |
| Inventive 3 | FIG. 7 | Y | 56.7 | 9.3 |

The two-ply tissue product was then converted into a rolled towel product and subjected to physical testing, the results of which are shown in Tables 5 and 6, below.

TABLE 5

| Inventive Sample | BW (gsm) | Caliper (μm) | Sheet Bulk (cc/g) | GMT (g/3") | Tensile Ratio | GM Slope (kg) | Stiffness Index |
|---|---|---|---|---|---|---|---|
| Inventive 1 | 52.0 | 858 | 16.5 | 3160 | 1.3 | 12.5 | 3.95 |
| Inventive 2 | 51.8 | 992 | 19.2 | 3175 | 1.3 | 13.2 | 4.16 |
| Inventive 3 | 50.1 | 914 | 18.3 | 3157 | 1.4 | 12.9 | 4.08 |

TABLE 6

| Inventive Sample | $W_I$ (g) | $W_{Residual}$ (g) | $W_D$ (g) | DT (sec.) | $W_{Retained}$ (g) | Liquid Absorbed and Retained (%) | Absorbed Liquid Retention (%) |
|---|---|---|---|---|---|---|---|
| Inventive 1 | 5.02 | 0.08 | 0.00 | >60 | 4.94 | 98.4% | 100.0% |
| Inventive 2 | 5.01 | 0.09 | 0 | >60 | 4.920 | 98.3% | 100.0% |
| Inventive 3 | 5.01 | 0.07 | 0 | >60 | 4.936 | 98.5% | 100.0% |

EMBODIMENTS

In a first embodiment the present invention provides an embossed multi-ply tissue product comprising a first outer surface, an opposed second outer surface and a plurality of embossments disposed on at least the first outer surface, the product having a Drip Time (DT) greater than about 30 seconds.

In a second embodiment the present invention provides the tissue product of the first embodiment having a Residual Water ($W_{Residual}$) value from about 0.05 to about 0.15 g.

In a third embodiment the present invention provides the tissue product of the first or second embodiments having a Liquid Absorbed and Retained rate greater than about 94 percent.

In a fourth embodiment the present invention provides the tissue product of any one of the first through third embodiments having a Fluid Discharge Weight ($W_D$) less than about 0.10 g.

In a fifth embodiment the present invention provides the tissue product of any one of the first through fourth embodiments having a basis weight from about 40 to about 60 grams per square meter (gsm) and a geometric mean tensile (GMT) from about 2,000 to about 4,000 g/3".

In a sixth embodiment the present invention provides the tissue product of any one of the first through fifth embodiments wherein the plurality of embossments are discrete line elements and the embossed area is less than about 10 percent.

In a seventh embodiment the present invention provides the tissue product of any one of the first through sixth embodiments wherein the tissue product comprises a first tissue ply and a second tissue ply, the first tissue ply having a first upper surface and a plurality of embossments disposed thereon are discrete line elements and the embossed area is less than about 10 percent.

In an eighth embodiment the present invention provides the tissue product of any one of the first through seventh embodiments wherein the embossments disposed thereon are discrete line elements and are non-linear.

In a ninth embodiment the present invention provides the tissue product of any one of the first through eighth embodiments further comprising a background pattern disposed on at least the first outer surface. In certain embodiments the background pattern comprises a plurality of spaced apart, parallel line elements having a width from about 2.0 to about 6.0 mm.

In a tenth embodiment the present invention provides the tissue product of any one of the first through ninth embodiments having a wet elastic strain ratio greater than about 32 percent.

In an eleventh embodiment the present invention provides the tissue product of any one of the first through tenth embodiments having a GM Flexural Rigidity less than about 600 mg*cm.

In a twelfth embodiment the present invention provides the tissue product of any one of the first through eleventh embodiments having a ratio of CD Flexural Rigidity to MD Flexural Rigidity greater than 1.

What is claimed is:

1. An embossed multi-ply tissue product comprising a first through-air dried tissue ply and a second through-air dried tissue ply, the first and the second through-air dried tissue plies each comprising a permanent wet strength resin and the first through-air dried tissue ply having a first outer surface, an opposed second outer surface, a background pattern disposed on the first outer surface and a plurality of discrete, non-linear embossments disposed on the first outer surface, wherein the background pattern consists of a plurality of parallel, spaced apart line elements that are periodically intersected by the plurality of embossments, the product having a basis weight of at least about 40 grams per square meter (gsm) and a Drip Time (DT) greater than about 30 seconds.

2. The embossed multi-ply tissue product of claim 1 having a Residual Water ($W_{Residual}$) value from about 0.05 to about 0.15 g.

3. The embossed multi-ply tissue product of claim 1 having a Liquid Absorbed and Retained rate greater than about 94 percent.

4. The embossed multi-ply tissue product of claim 1 having a Fluid Discharge Weight ($W_D$) less than about 0.10 g.

5. The embossed multi-ply tissue product of claim 1 wherein the first and second through-air dried plies are uncreped.

6. The embossed multi-ply tissue product of claim 1 having a basis weight from about 40 to about 60 grams per square meter (gsm) and a geometric mean tensile (GMT) from about 2,000 to about 4,000 g/3".

7. The embossed multi-ply tissue product of claim 1 having an embossed area less than about 10 percent.

8. The embossed multi-ply tissue product of claim 1 having a sheet bulk from about 15 to about 20 cubic centimeters per gram (cc/g).

9. The embossed multi-ply tissue product of claim 1 having a GMT greater than about 3,000 g/3" and a Stiffness Index from about 3.0 to about 6.0.

10. A dripless tissue product comprising a first tissue ply and a second tissue ply, the first tissue ply having a first upper surface, a background pattern disposed on the first upper surface and a plurality of embossments disposed on the first upper surface, wherein the plurality of embossments intersect the background pattern and wherein the background pattern consists of a plurality of spaced apart, parallel line elements having a width from about 2.0 to about 6.0 mm and the embossments consist of discrete, non-linear elements and have an embossed area less than about 10 percent of area of the first upper surface, the tissue product having a basis weight from about 50 to about 60 gsm, a GMT from about 3,000 to about 4,000 g/3" and a Fluid Discharge Weight ($W_D$) of less than 0.15 g.

11. The dripless tissue product of claim 10 having a Residual Water ($W_{Residual}$) value less than about 0.15 g.

12. The dripless tissue product of claim 10 having a Liquid Absorbed and Retained rate from about 94 to about 99 percent.

13. An embossed multi-ply tissue product having a first outer surface and an opposed second outer surface, the product comprising first and second through-air dried tissue plies, the first through-air dried tissue ply having a first surface which forms the first outer surface of the product, a background pattern consisting of a plurality of spaced apart, parallel line elements having a width from about 2.0 to about 6.0 mm disposed on the first outer surface of product and a first embossing pattern comprising discrete, non-linear line elements disposed on the first outer surface of product, wherein the embossing pattern intersects the background pattern and covers from about 5.0 to about 10.0 percent of the first outer surface of the tissue product, the product having a basis weight from about 50 to about 60 gsm, a GMT from about 3,000 to about 4,000 g/3" and a Drip Time (DT) greater than about 30 seconds.

14. The embossed multi-ply tissue product of claim 13 having a Drip Time (DT) greater than about 45 seconds.

15. The embossed multi-ply tissue product of claim 13 having a Residual Water ($W_{Residual}$) value less than about 0.15 g.

16. The embossed multi-ply tissue product of claim 13 having a Liquid Absorbed and Retained rate greater than about 94 percent.

17. The embossed multi-ply tissue product of claim 13 having a Fluid Discharge Weight ($W_D$) less than 0.15 g.

18. The embossed multi-ply tissue product of claim 13 having a sheet bulk from about 15 to about 20 cubic centimeters per gram (cc/g).

19. The embossed multi-ply tissue product of claim 13 having a Stiffness Index from about 3.0 to about 6.0.

20. The embossed multi-ply tissue product of claim 13 wherein the discrete, non-linear line elements have an element length from about 20.0 to about 60.0 mm and a depth from about 500 to about 800 μm.

21. The embossed multi-ply tissue product of claim 13 wherein the embossed area comprises from 0.0 to about 1.0 percent dot embossments and from about 5.0 to about 10.0 percent discrete, non-linear line elements.

* * * * *